United States Patent [19]

Ishibashi et al.

[11] Patent Number: 4,915,027

[45] Date of Patent: Apr. 10, 1990

[54] HAND-HELD MANUALLY OPERABLE PRINTING APPARATUS

[75] Inventors: Norio Ishibashi, Akishima; Kazuki Yamauchi, Hino; Satoshi Aso, Chofu; Atsushi Sagisaka, Hino, all of Japan

[73] Assignee: Casio Computer Co., Ltd., Tokyo, Japan

[21] Appl. No.: 170,714

[22] Filed: Mar. 21, 1988

[30] Foreign Application Priority Data

| | | | |
|---|---|---|---|
| Mar. 28, 1987 | [JP] | Japan | 62-74866 |
| Apr. 10, 1987 | [JP] | Japan | 62-80769 |
| Apr. 20, 1987 | [JP] | Japan | 62-96848 |
| Apr. 20, 1987 | [JP] | Japan | 62-96851 |

[51] Int. Cl.[4] ..... B41F 1/34; B41J 3/36

[52] U.S. Cl. ..... 101/486; 400/29; 400/73; 400/88; 400/110; 400/120; 346/76 PH

[58] Field of Search ..... 400/29-31, 400/88, 120, 110, 73; 346/76 PH; 219/216 PH; 101/485, 486

[56] References Cited

U.S. PATENT DOCUMENTS

| | | | |
|---|---|---|---|
| 3,767,020 | 10/1973 | Rowe | 400/88 |
| 4,168,533 | 9/1979 | Schwartz | 400/88 |
| 4,412,232 | 10/1983 | Weber et al. | 400/88 |
| 4,464,669 | 8/1984 | Sekiya et al. | 346/76 PH |
| 4,523,235 | 6/1985 | Rajchman | 400/88 |
| 4,544,276 | 10/1985 | Horodeck | 400/110 |
| 4,560,993 | 12/1985 | Hakoyama | 346/76 PH |
| 4,567,488 | 1/1986 | Moriguchi et al. | 219/216 PH |
| 4,699,052 | 10/1987 | Lemelson | 101/110 |
| 4,750,049 | 6/1988 | Murakami | 358/296 |

FOREIGN PATENT DOCUMENTS

| | | | |
|---|---|---|---|
| 138444 | 4/1985 | European Pat. Off. | 400/88 |
| 191068 | 11/1982 | Japan | 400/88 |
| 89390 | 5/1985 | Japan | 400/88 |
| 29563 | 2/1986 | Japan | 400/88 |
| 64469 | 4/1986 | Japan | 400/88 |
| 154871 | 7/1986 | Japan | 400/88 |
| 258756 | 11/1986 | Japan | 400/88 |
| 283574 | 12/1986 | Japan | 400/29 |
| 286172 | 12/1986 | Japan | 400/88 |
| 27161 | 2/1987 | Japan | 400/88 |
| 116172 | 5/1987 | Japan | 400/88 |

OTHER PUBLICATIONS

Kambic, "Selectable Area-Printer Plotter" IBM Tech. Disclosure Bulletin, vol. 17, No. 2, pp. 565-567, 7-74.

"Hand Held Serial Printer" #25403 Research Disclosure Jun. 1985, #254, Kenneth Mason Publication, Ltd. England.

Patent Abstracts of Japan, vol. 8, No. 274, Dec. 14, 1984.

*Primary Examiner*—Eugene H. Eickholt

*Attorney, Agent, or Firm*—Frishauf, Holtz, Goodman & Woodward

[57] ABSTRACT

A manually operable sweeping-type compact printer apparatus includes a key entry unit, a display unit, a memory unit, an encoder and a printer unit which are mounted on a manually manipulatable housing. When the housing is manually moved over a printing medium with the printer unit in contact with the printing medium, data entered by the key entry unit is printed out on the printing medium. In the printer apparatus, only designated segments or lengths of data are printed out on the printing medium, independent of continued travel or movement of the housing. Also, even if the housing is moved over the printing medium at an unstable moving velocity, high printing quality can be realized by control of the printing head. Stop codes designating the end of a data segment can be automatically or manually inserted.

37 Claims, 15 Drawing Sheets

東京：千代田区、中央区、港区、渋谷区、新宿区、豊島区、台東区、品川区、目黒区、江東区、世田谷区、

東京：千代田区、ST 中央区、港区、渋谷区、ST 新宿区、豊島区ST、台東区、品川区、

| | | | | | | | | | |
|---|---|---|---|---|---|---|---|---|---|
| ST | 福 | 生 | 市 | ST | 昭 | 島 | 市 | ST | 羽 |
| 村 | 町 | ST | 立 | 川 | 市 | ST | 東 | 大 | 和 |
| 市 | ST | 国 | 立 | 市 | ST | 日 | 野 | 市 | ST |
| 八 | 王 | 子 | 市 | ST | 国 | 分 | 寺 | 市 | |
FIG. 6
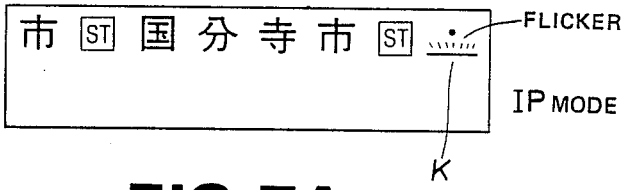
FIG. 7A
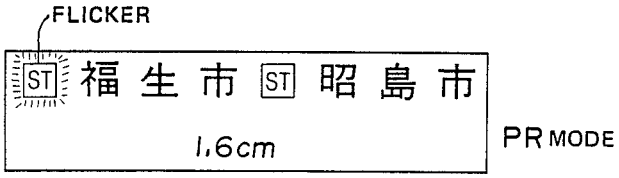
FIG. 7B

| PREVIOUS HEATING DATA | HEATING DATA BEFORE PREVIOUS HEADING DATA | SPEED | WAVEFORM OF PRESENT HEATING DATA |
|---|---|---|---|
| 0 | 0 | FAST |   |
| 0 | 0 | SLOW |   |
| 0 | 1 | FAST |  |
| 0 | 1 | SLOW |  |
| 1 | 0 | FAST |  |
| 1 | 0 | SLOW |  |
| 1 | 1 | FAST |  |
| 1 | 1 | SLOW |  |

BASIC HEATING TIME PERIOD $t_0 = t + t_1 + t_2 = t' + t'_1 + t'_2$

| ENCODER PULSE INTERVAL (msec) | t (μsec) |
|---|---|
| 0 ~ 3.5 | 700 |
| 3.5 ~ 4.0 | 800 |
| 4.0 ~ 4.5 | 900 |
| 4.5 ~ 5.0 | 1000 |
| 5.0 ~ 5.5 | 1100 |
| 5.5 ~ 6.0 | 1200 |
| 6.0 ~ 6.5 | 1300 |
| 6.5 ~ | 1400 |

FIG.14

HAND-HELD MANUALLY OPERABLE PRINTING APPARATUS

BACKGROUND OF THE INVENTION

1. Field of the Invention

The present invention generally relates to a manually operable sweeping-type printing apparatus, and, more particularly, to a manually operable printer apparatus where data previously stored in a memory is printed out on a printing medium, while manually sweeping the printer apparatus over a printing medium.

2. Description of the Related Art

Various types of manually operable sweeping-type printers are known in the art, for example, U.S. Pat. No. 3,767,020 issued to Rowe on Oct. 23, 1973, entitled "MANUALLY POSITIONABLE AUTOMATIC PRINTER". In the manually movable housing of this known printer, there are provided a printer head, an ink ribbon, rotatable rollers in contact with the printing medium, and a timing-signal generating unit for producing a timing signal in accordance with a travel distance over which the printer housing has been moved. A control unit and memory unit connected with each other by means of a connection cord are arranged in the printer housing.

While the printer housing is manually moved over the printing medium, the information previously stored in the memory unit is printed out on the printing medium. Since the printing control is performed based upon the actual movement of the housing of the manually sweepable automatic printer, an operator should stop moving the printer housing when printing out of the desired data is completed when, for example, the operator wishes to print out only a desired portion or segment of the stored data on the printing medium. However, if the operator accidentally stops moving the printer housing before, or after, the printing of the desired data segment or portion is completed, the following drawbacks are incurred. If the operator stops moving the printer housing before the desired data printing is completed, a portion, or fragment, of the desired data segment to be printed may be incomplete. Alternatively, if the operator continues to move the printer housing after the desired data printer is completed, another portion of the data succeeding the above-described desired portion of data (i.e., desired data segment) may be additionally printed out on the printing medium. These effects are disadvantageous and lead to poor printing results.

In addition, it is practically difficult to manually move or sweep the printer housing over the printing medium at a constant sweeping speed. As a result, the resultant printing quality is lowered.

Under the above-described circumstances, using the above type of prior art device, a highly skilled sweeping technique is necessarily required for printer operators in order to obtain a satisfactory printing result. Moreover, a difficulty may exist in achieving the same printing conditions, i.e., the same printing quality and the same actual printed form, every time the same printer operator manually moves or sweeps the printer housing to print out the data stored in the memory unit.

SUMMARY OF THE INVENTION

It is therefore an object of the invention to provide a manually sweepable printer capable of printing out only the desired portions or segments of data stored in the memory at the desired printing positions on the printing medium.

Another object of the invention is to provide a manually sweepable printer capable of printing out the data with a higher printing quality and uniformity.

These objects of the invention are accomplished by providing a hand-held electronic printing apparatus comprising a manually manipulatable housing means which is manually sweepable across a printing medium; printing means carried by the housing means for printing information on a printing medium positioned outside of the housing means, when the housing means is manually swept across the printing medium; position-detecting means for detecting a position of the printing means relative to the printing medium as the housing means is manually swept across the printing medium, and for producing position-detecting signals every time the housing means is swept over a predetermined distance, the position-detecting signals representing the position of the housing means with respect to the printing medium; and signal source means for sequentially supplying information signals corresponding to information to be printed, to the printing means, the information signals being segmented corresponding to a predetermined segment length of information to be printed by the printing means. Further provided is control means for controlling the printing means in response to the position-detecting signals and for causing the printing means to print the information on the printing medium in response to the information signals supplied thereto by the signal source means; detecting means for detecting the end of a segment length of the information signals sequentially supplied to the printing means and for outputting a detection signal responsive to detection of the end of at least one segment length of the segmented information signals; and stopping means coupled at least to the detecting means for stopping a printing operation of the printing means in response to the detection signal output from the detecting means, thereby stopping printing at the end of a segment regardless of further sweeping of the housing means relative to the printing medium.

BRIEF DESCRIPTION OF THE DRAWINGS

FIG. 6 schematically illustrates the memory contents of the data memory unit of the printer apparatus;

FIG. 7A and 7B schematically illustrate conditions of the display unit in the input mode and print mode of the printer apparatus;

Figs. 3A and 13B are graphical representations showing a relationship between the moving velocity of the printer housing and the time for supplying power to the printer head; and FIG. 14 shows a table for determining the time for supplying power to the printer head in order to illustrate a second determination method thereof of the manually sweeping apparatus.

DETAILED DESCRIPTION

Figure 1:
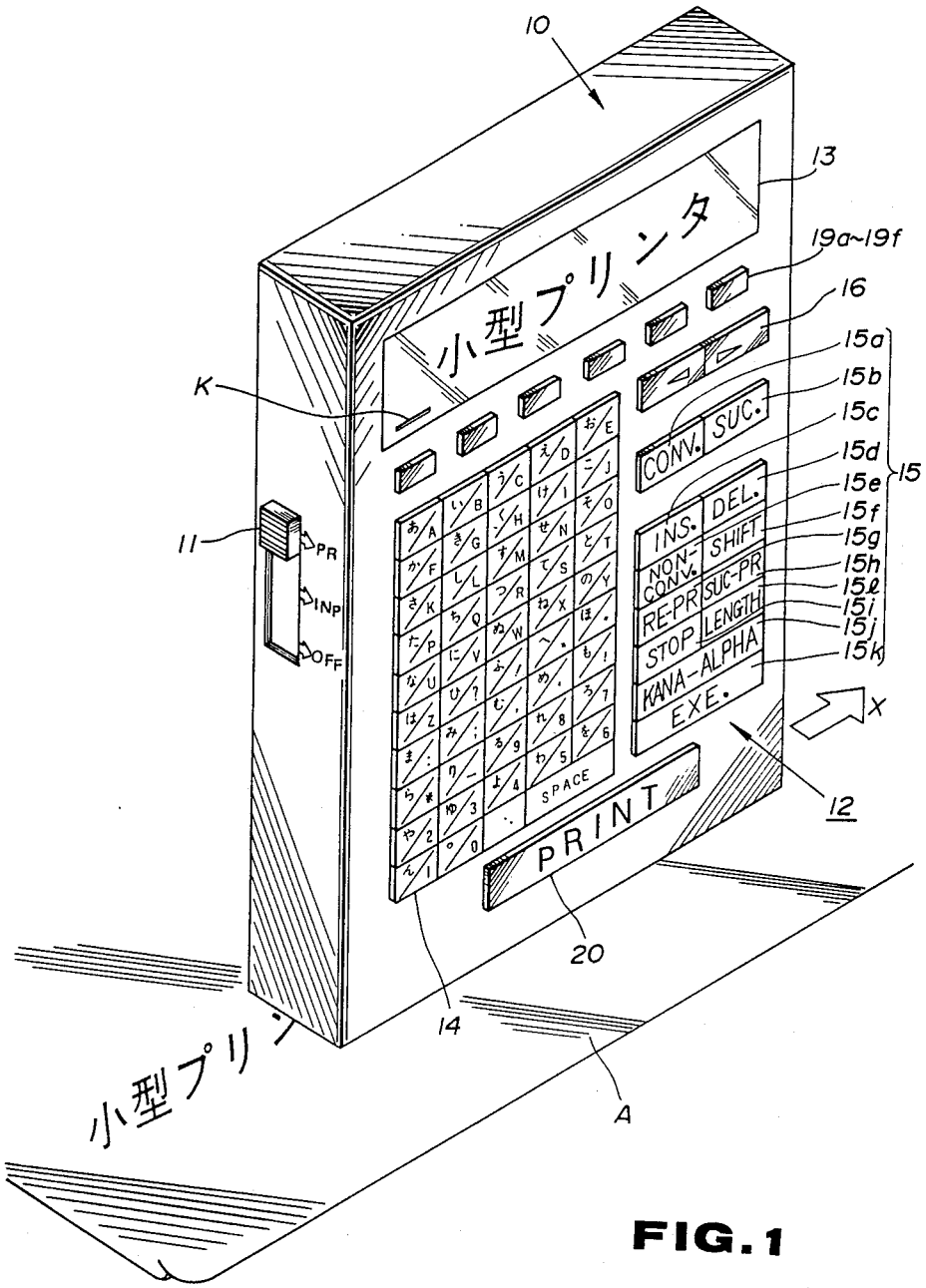
FIG. 1 is a perspective view of a manually operable sweeping-type compact printer apparatus according to one preferred embodiment of the invention.

Referring now to the drawings, a manually operable sweeping-type compact printer apparatus, which can produce Japanese sentence segments or sentences, or English sentence segments or sentences, store these entered sentence segments or sentences into a memory, and print them out accurately onto a printing medium at precise positions on the printing medium, by appropriately reading out these stored sentence segments or sentences from the memory.

For a better understanding of the overall operation of the printer apparatus, the following description will be made for making Japanese sentences and/or sentence segments, Japanese words, and, furthermore, a method for imputing Japanese sentences.

A Japanese sentence or sentence segment is formed by combining a phonogram of "HIRAGANA" with an ideogram of "KANJI". "KANJI" can be expressed by "HIRAGANA" in a phonetic expression. In Japanese, a specific meaning can be expressed by only one KANJI character, plural KANJI characters, or by combining "HIRAGANA" with KANJI characters. There are many cases where KANJI characters having different meanings have the same pronunciation.

Taking into account the above-described features of Japanese, the manually operable sweeping-type printer apparatus according to one preferred embodiment of the present invention employs a conversion method to make up a Japanese sentence wherein "HIRAGANA" characters are entered by a key, and the entered "HIRAGANA" characters are converted into corresponding "KANJI" characters, if required. As the "KANJI" definition method, appropriate "KANJI" characters are designated from reference "KANJI" characters since a plurality of "KANJI" characters may often possibly correspond to the same HIRAGANA key-inputs.

Construction Of Compact Printer Apparatus

Referring now to FIG. 1, a detailed construction of the manually operable sweeping-type compact sentence-making printer apparatus according to one preferred embodiment will be described.

In FIG. 1, there is provided a printer body 10 which is manufactured in the size of, for example, 86 mm (width), by 35 mm (thickness) by 167 mm (height). The size is not critical, but it should be small enough to be hand-held. Accordingly, any operator can readily hold the printer body 10 and manually operate it. A mode changing switch 11 is provided on the left side of the printer body 10. Functions of the mode changing switch 11 are to turn ON/OFF the power supply, and switch the key input mode INP and the print mode PR. In the FIG. 1 embodiment, the power supply is turned on by operating the switch 11 to designate the above-described key input mode INP, or print mode PR.

A key input, or entry unit 12 and a display unit 13 are mounted on a front panel of the printer body 10. The key entry unit 12 comprises character/symbol entry keys 14; function keys 15; cursor keys 16; KANJI selection keys 19*a* to 19*f*; and a print key 20.

The character/symbol entry keys 14 are used to enter HIRAGANA characters, alphabetical letters, numbers, symbols and so on. The function keys 15 comprise a conversion key (CONV) 15*a*; a succeeding reference character key (SUC) 15*b*; an insertion key (INS) 15*c*; a deletion key (DEL) 15*d*; a non-conversion key (NON-CONV) 15*e*; a shift key (SHIFT) 15*f*; a re-print key (RE-PR) 15*g*; a succeeding printing-operation (SUC-PR) key 15*h*; a stop (STOP) key 15*i*; a HIRAGANA-/alphabet (KANA-ALPHA) key 15*j*; an execution (EXE) key 15*k*; and a length (LENGTH) key 151. The conversion key 15*a* is used for instructing a conversion from the entered HIRAGANA into the corresponding KANJI. The succeeding reference character key 15*b* is employed to display other reference KANJI characters than the displayed KANJI character when a plurality of reference KANJI characters may possibly correspond to the HIRAGANA character which should be converted into the desired KANJI character. The non-conversion key 15*e* is employed to instruct registration of the entered HIRAGANA without converting into KANJI. Both the re-print key 15*g* and the succeeding print key 15*h* are employed to select the data to be printed out.

The stop key 15*i* is employed to segment a character series entered by the above-described character/symbol entry keys 14 at a proper position so as to separate the entered character series into a plurality of character groups or segments. The HIRAGANA/alphabet entry key 15*j* is used to specify types of data which can be entered by the character/symbol entry keys 14. Generally speaking, the entry key 15*j* instructs whether HIRAGANA characters, or alphabetical characters are to be entered. The length key 151 is employed to designate the printing length so that a segmented character series is printed which corresponds to the designated segment length (i.e., the designated number of characters to be printed in a segment). The KANJI selection keys 19*a* to 19*f* are used to instruct one KANJI character selected from the possible reference KANJI characters to be displayed on the display unit 13.

The display unit 13 is a dot matrix type liquid crystal display apparatus that can display two columns and eight characters in Japanese (2 columns-16) characters in English. Other types of display apparatus can be used, but a liquid crystal type is preferred for a compact portable device. The display unit 13 displays the data entered by the character/symbol entry keys 14, the conversion KANJI (reference KANJI), and cursor "K".

Printer Unit And Ink Ribbon Cassette

Figure 2:
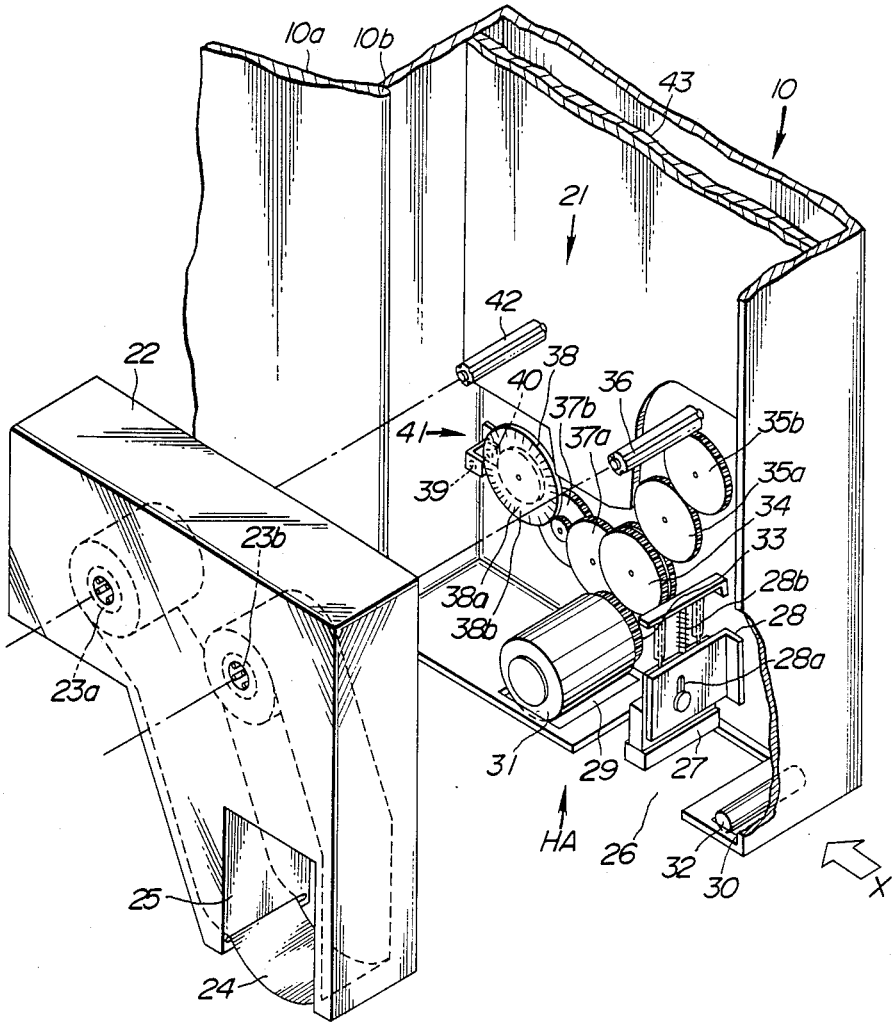
FIG. 2 is a perspective view of the printer unit of the printer apparatus shown in FIG. 1.

In FIG. 2, there is shown a printer unit 21 and an ink ribbon cassette 22 arranged in the above-described manually operable sweeping-type compact segment-making printer apparatus.

A thermal printer head 27 is provided in such a manner that a head surface 27*a* of the thermal printer head 27 projects from the lower surface of the printer body 10 near a central portion of a printing window 26 which is formed on the lower surface of the printer body 10. The thermal printer head 27 can be vertically moved along a slide hole 28*a* of a head mounting member 28, and is continuously resiliently depressed or biased downwardly by means of a spring 28*b*, so that during a printing operation, head contact pressure can be established between the printing medium, e.g., plain paper "A" (see FIG. 1), and the thermal printer head 27.

On the lower surface of the printer body 10, two openings 29 and 30 are respectively formed on both sides of the printing window 26. Two rollers, i.e., large rollers 31 and small roller 32, are provided in such a manner that portions of these rollers 31 and 32 project outwardly through the respective openings 29 and 30 from the printer body 10. When the printer body 10 is transferred or moved (i.e., swept) in a direction denoted by the arrow X in FIG. 2, rollers 31 and 32 rotate in contact with the recording medium A in response to the movement of the printer body 10. A gear 33 rotated by the roller 31 is coaxially mounted on roller 31. Gear 33 transfers its rotation to another gear 34 having a one-way clutch mechanism. Gear 34 transfers its rotation to gears 35*a* and 37*a* while the above-described gear 33 rotates in a specific rotating direction; that is the printer body 10 is moved in the direction indicated by the arrow X. The rotation torque of the gear 35*a* is transferred via the gear 35*b* to a ribbon take-up shaft 36. The rotation torque of the gear 37*a* is also transferred via the gear 37*b* to an encoder disk 38. With the above gear mechanism, both the ribbon take-up shaft 36 and the encoder 38 can be rotated only when the printer body 10 is moved or swept in the X-direction. In the encoder disk 38, a plurality of slits 38*a*, 38*b*, . . . are radially formed at predetermined intervals. Adjacent to the slit forming section of the encoder disk 38, an LED (light emitting diode) 39 and a photosensor 40 are mounted on opposite sides of the disk 38 so as to sandwich the slit forming section with the LED 39 positioned opposite to the photosensor 40. With this LED-photosensor arrangement, the light emitted from the LED 39 is interruptedly incident upon the photosensor 40 while passing through the slits 38*a*, 38*b*, . . . of the encoder disk 38 during the rotation of the encoder disk 38. The encoder disk 38, LED 39 and photosensor 40 constitute an encoder 41.

An ink ribbon cassette 22 is employed in the printer body 10 as shown in FIG. 2. The shape of the ink ribbon cassette 22 is so designed as to be mounted within printer unit 21 of the printer body 10. In the ink ribbon cassette 22, there are employed a ribbon supply spool 23*a* engaged with a supporting shaft 42 provided in the printer unit 21 when the ribbon cassette 22 is mounted on the printer body 10, and a ribbon take-up spool 23*b* engaged with the ribbon take-up shaft 36. A thermal ink ribbon 24 is wound on the two spools 23*a* and 23*b*. A notch portion 25 is formed in the ink ribbon cassette 22 in such a manner that when the ink ribbon cassette 22 is installed in the printer body 10, a thermal head 27 can be inserted into its lower end. The ink ribbon 24 is exposed from the cassette 22 at the above-described notch portion 25, and is positioned between the thermal head 27 and the recording medium A when the cassette 22 is mounted on the printer body 10.

A rear plate 10*a* is hinged with the printer body 10 by a hinge 10*b*, so that the ink ribbon cassette 22 can be detachably mounted within the printer unit 21.

A printed circuit board 43 is arranged between the printer unit 21 and the front panel of the printer body 10, to which the above-described keys 12, switches 11, display unit 13, encoder 41, and thermal head 27, etc. are electrically connected.

Circuit Arrangement of Printer

Figure 3:
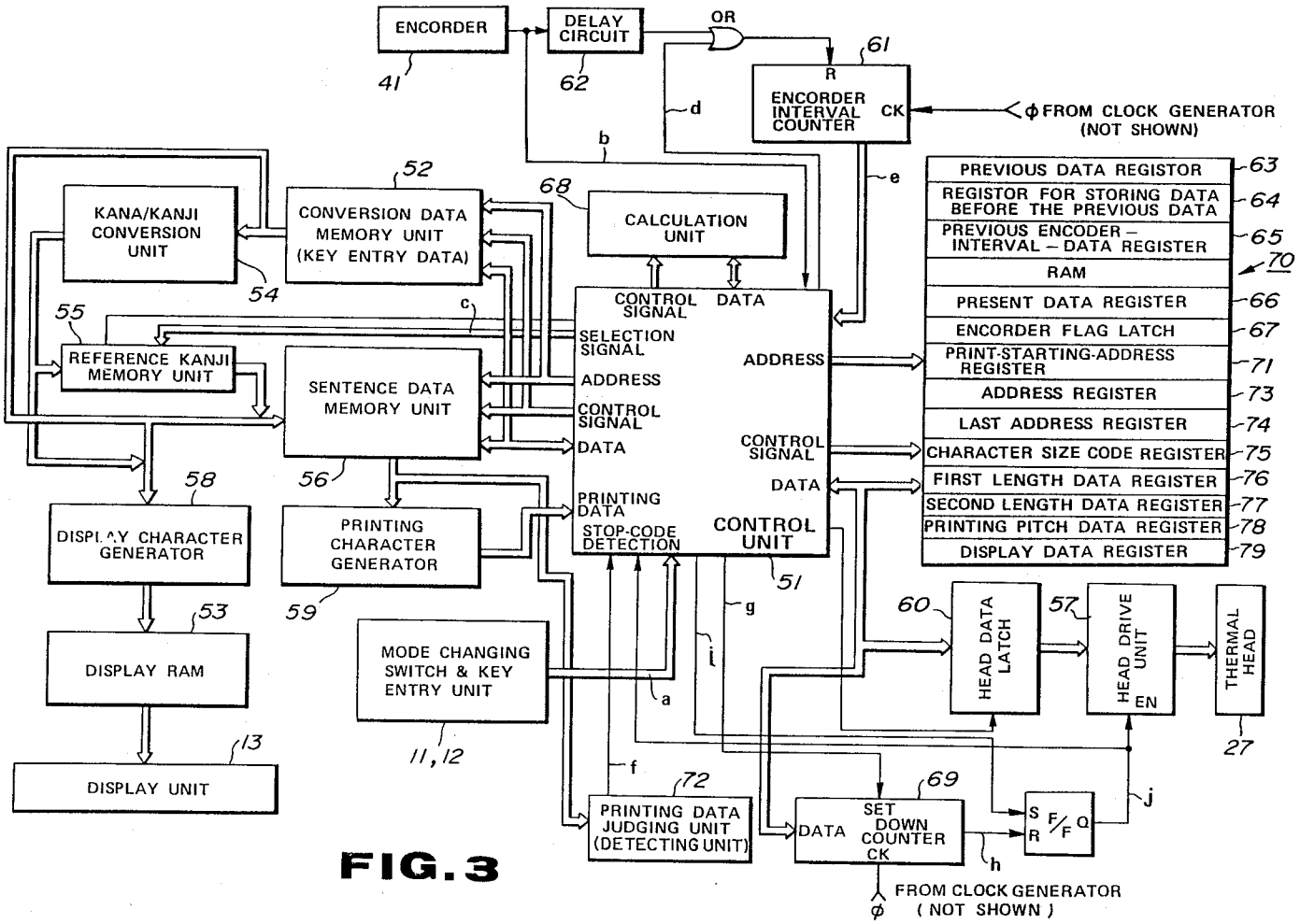
FIG. 3 is a schematic block diagram of the electronic circuitry employed in the printer apparatus of the invention.

FIG. 3 illustrates electronic circuitry fabricated on the printed circuit board 43.

A control unit 51 is provided into which various signals are input. The input signals are, for example, mode changing and key input signals "a" supplied from the mode changing switch and key input or entry unit 11, 12; and an encoder pulse signal "b" supplied from the encoder 41. In response to various key operations, signals "a" supplied from the mode changing switch 11 and key input unit 12 are supplied to control unit 51. The control unit 51 controls a conversion data (key entry data) memory unit 52, a display RAM 53, a KANA/KANJI conversion unit 54, a reference KANJI memory unit 55, a segment data or sentence data memory unit 56, and a head drive unit 57. The conversion data memory unit 52 sequentially stores the character/symbol data corresponding to characters/symbols entered from the key entry unit 12 when the HIRAGANA entry is selected by the HIRAGANA/alphabet key 15*j*. The key-entered character/symbol data stored in conversion data memory unit 52 is displayed on the display unit 13 via the display character generator 58 and display RAM 53.

The KANA/KANJI conversion unit 54 converts to the KANJI corresponding to the "HIRAGANA" contained in the key-entered character signal data which has been stored in the conversion data memory unit 52. When the conversion process operation commences in the control unit 51 in response to the key operation of the KANA/KANJI conversion key in the key entry unit 12, the KANJI converted by the above-described KANA/KANJI conversion unit 54 is stored in the reference KANJI memory unit 55, and is read from this memory unit 55 to be displayed on the display unit 13. If a plurality of KANJI characters converted in the KANA/KANJI conversion unit 54 are present, which exceed a limited number corresponding to the display capacity of the display unit (i.e., 8 characters), the control unit 51 then performs the succeeding reference KANJI process operation in accordance with the key operation of the succeeding substitution-character key 15*b* in the key entry unit 12. Accordingly, other non-displayed reference KANJI characters are sequentially read out from the reference KANJI memory unit 55, and are thus displayed on the display unit 13. When the selection signal "C" is input from the control unit 51 into the reference KANJI memory unit 55 in response to any key operation of the KANJI selection keys 19*a* to 19*f* in the key entry unit 12, one of the reference KANJI characters is output to the segment or sentence data memory unit 56 in accordance with the key operation of the KANJI selection keys 19*a* to 19*f*. The various data stored in the conversion data memory unit 52, e.g., the HIRAGANA data obtained by depressing the non-conversion key 15*d*, the symbol data which is not required for the KANJI conversion, or the stop code entered in response to the key operation of the stop key 15*i*, are properly transferred to the segment or sentence (hereinafter referred to simply as "sentence" for ease of description) data memory unit 56. When the alphabet entry is selected on the key entry unit 12, the key-entered data is directly transferred to the sentence data memory unit 56.

The function of the sentence (or segment) data memory unit 56 is to store a sentence segment or sentence data constituted by KANJI, HIRAGANA, alphabet, numerals and/or symbols, which is produced as the sentence segment or sentence information by operating the key entry unit 13. The respective character and symbol data of the sentence data stored in the sentence data memory unit 56, are output to the display unit 12 via the display character generator 58 and display RAM 53. The data preViously stored in the sentence data memory unit 56 is read into the control unit 51 and printing data judging unit 72, when the print mode is designated.

During the print operation of the print mode, when the print mode is designated, the data output from the data memory unit 56 is also supplied to a printing data judging unit (i.e., detecting unit) 72. The printing data judging unit or detecting unit 72 detects a stop code which has been input and stored into the data memory unit 56 in response to the operation of the stop key 15*i*, among the data output from the data memory unit 56. When the above stop code is detected, the printing data judging unit 72 outputs a stop-code detecting signal "f" to the control unit 51.

Upon receipt of the "stop" code detecting signal "f", the control unit 51 instructs the display unit 13 to display a printing length of the sentence data which has been calculated in the calculation unit 68 and have been so far output from the sentence data memory unit 56. When the print key 20 is operated during the print mode, the data previously stored in the sentence data memory unit 56 are output via the printing data judging unit 72 and the printing character generator 59 to the control unit 51. Thereafter, the readout data are output via a head data latch 60 to the head drive unit 57 from the control unit 51. Then, when the stop code detecting signal "f" is input into the control unit 51 in the above-described data transfer condition, the control unit 51 stops reading the segment or sentence data which has been stored so far in the sentence data memory unit 56, and also stops the printing operation of the thermal head 27. In addition, the control unit 51 enables an address value succeeding the address value, which the sentence data memory unit 56 is designated, when the stop code detecting signal "f" is supplied, to be stored in a print-starting-address register 71 in RAM 70 (to be discussed later). The first-mentioned address value corresponds to the address value subsequent to the address value of the sentence data memory unit 56 where the stop code has been stored.

When the succeeding print key 15*h*, or the re-print key 15*g* is depressed in the print mode, the control unit 51 sequentially increments, or decrements the address value, as a basic point, stored in the print-starting-address register or memory unit 71, or the head address of the sentence data memory unit 56, and then outputs the data from data memory unit 56 to the printing data judging or detecting unit 72. Then, the control unit 51 immediately stops addressing the sentence data memory unit 56 in a similar manner with the printing operation, when the stop code detecting signal "f" is output from the printing data judging or detecting unit 72. Simultaneously, the control unit 51 causes the print-starting-address register 71 to store the address value next to the address value which has stored the stop code. In this case, the display unit 13 displays the data succeeding another data which is stored at the address value of the print-starting-address register 71 of the sentence data memory unit 56. During the above-described printing operation, the data which have been stored in the address of the sentence data memory unit 56 stored in the print-starting address-register 71 are successively printed out.

The encoder pulse "b" from the encoder 41 is supplied to both the control unit 51, and, via a delay circuit 62 and an OR gate "OR" to a reset terminal "R" of an encoder interval counter 61. A reset signal "d" is supplied from the control unit 51 via the OR gate "OR", to the reset terminal R of encoder interval counter 61, and a clock signal $\phi$, from a clock signal generating unit (not shown in detail) is supplied to a clock terminal "CK" thereof. The encoder interval counter 61 counts the pulse intervals of the encoder pulse "b" output from the encoder 41 in synchronism with the clock signal $\phi$, and outputs its count value "e" to the control unit 51.

Reference numeral 70 indicates a RAM (random access memory). RAM 70 is addressed under the control of the control unit 51, and functions to input/output the data into/from the control unit 51. RAM 70 includes a previous data register 63; a register 64 for storing data before the previous data; a previous encoder-interval-data register 65; a present data register 66; an encoder flag latch 67; the print-starting-address register 71; an address register 73; a last address register 74; a character size code register 75; a first length data register 76; a second length data register 77; a printing pitch data register 78; and a display data register 79. The previous data register 63, register 64 for storing data before the previous data, and present data register 66 will store the print data to be printed by the thermal head 27 in response to each encoder pulse "b". In other words, the previous data register 63 stores the print data which has been printed in response to the last but one (i.e., next-to-last) encoder pulse "b" output by the encoder 41. The register 64 stores the print data which has been printed in response to the last but two (i.e., two encoder 41. The present data register 66 stores the print data which has been printed in response to the last encoder pulse "b" output by the encoder 41. It should be noted that the above-described print data is 48-bit data corresponding to the respective dots of the thermal head 27, and can be represented as white (0) or black (1) data.

The previous encoder-interval-data register 66 stores the time interval between the previous print timing and the print timing before the previous print timing. That is the register 66 stores the count value of encoder interval counter 61 corresponding to the time interval from the time of output of the last but two encoder pulse "b" to the time of output of the last but one encoder pulse "b". When the next encoder pulse "b" is output from the encoder 41 while the head drive unit 57 enables the thermal head 27 to be brought into the printing operation, the flag "1" appears in the encoder latch 67. In addition, the print-starting-address memory unit 71 stores the head address of the print data of the segment or sentence data memory unit 56.

The address register 73 stores therein the address for designating the sentence data memory unit 56. The last address register 74 stores the address of the last data stored in the sentence data memory unit 56. The character size code register 75 stores the character size code of the data output from the sentence data memory unit 56. The first length data register 76 and the second length data register 77 store the length data calculated by the calculation unit 68 based upon the character size code stored in the character size code register 75, the designated length data by the length key 151 and the printing pitch data stored in the printing pitch data register 78. Also, the printing pitch data register 78 stores the printing pitch data which designates the length of the space existing between each of the printed characters. In addition, the display data register 79 stores the display data obtained by the calculation unit 68.

A calculation unit 68 is connected to the control unit 51. The calculation unit 68 calculates the printing length of the printing character series output from the sentence data memory unit 56, based on the character size code stored in the character size code register 75 and the printing pitch data stored in the printing pitch data register 78. The calculation unit 68 separately calculates as three time periods t, $t_1$, and $t_2$, the time periods for supplying power to a heating element of the thermal head 27 which is used for the present printing operation, based upon the following data. That is, there are the count value of the encoder interval corresponding to the moving velocity of the printer body 10, which is supplied from the encoder interval counter 61, the count value of the encoder interval between the time of output of the last but two encoder pulse "b" and the time output the last but one encoder pulse "b" which has been stored in the previous encoder-interval-data register 65, and the printing data which have been printed in response to the last but one encoder pulse "b" output by encoder 41, and also the last but two encoder pulse "b" output by encoder 41. These printing data are supplied from the previous data register 63 and the register 64 for storing data before the previous data.

It should be noted that the second-mentioned time period "$t_1$" is calculated in the calculation unit 68 (under control of control unit 51) based upon the count value of the encoder interval acquired during the time output of the last but one (i.e. next to last) encoder pulse "b" and the last but two encoder pulse "b". The first-mentioned time period "t" is calculated in calculation unit 68 by subtracting the time periods "$t_1$" and "$t_2$" from the base time "$t_0$" (e.g., 1,400 u sec.), i.e., $t=t_0-t_1-t_2$.

The resultant time periods t, $t_1$, and $t_2$ calculated in the calculation unit 68 are output via control unit 51, into a down counter 69. Down counter 69 performs its down counting every time the time periods t, $t_1$, $t_2$ calculated in the calculation unit 68 are set in synchronism with the output of the control signal "g" derived from the control unit 51. When the down counting is accomplished, a reset signal "h" is output to the flip-flop F/F from the down counter 69. Flip-flop F/F is set by the control signal "i" derived from the control unit 51 in synchronism with the control signal "g", and supplies its set output "j" to the head drive unit 57. While the set output "j" from flip-flop F/F is applied to the head drive unit 57, the heating element provided in the thermal head 27 is heated in response to the printing data.

OVERALL PRINTING OPERATION OF PRINTER APPARATUS

An overall printing operation of the manually operable sweeping-type compact printer apparatus with the above-described circuit arrangement will now be described.

First, when a sentence or a sentence segment (i.e., a group of characters) is input into the printer apparatus according to the preferred embodiment, the key entry mode INP is instructed by operating the mode changing switch 11. Accordingly, the control unit 51 can be set in such a manner that an operator operates the key entry unit 12 mounted on the printer body 10 to sequentially enter the desired characters and/or symbols.

If a Japanese sentence or sentence segment is desired to be entered, the operator operates the KANA/alphabet entry key **15*j* to instruct the HIRAGANA entry. All of the key entry data entered by the character/symbol entry keys 14 under these conditions are stored in the conversion data memory unit 52. The data stored in the conversion data memory unit 52 is converted into character pattern data in the display character generator 58, and thereafter transferred to the display RAM 53 and stored therein. Then, the data stored in the display RAM 53 is displayed on the display unit 13. When the KANA/KANJI conversion key 15*a* is depressed for the HIRAGANA data stored in the conversion data memory unit 52, this HIRAGANA data is transferred to the KANA/KANJI conversion unit 54. Then, the reference KANJI characters are selected in the KANA/KANJI conversion unit 54 based upon the HIRAGANA data entered from the conversion data memory unit 52, and the retrieved reference KANJI characters are transferred to the reference KANJI memory unit 55. The KANJI data stored in the reference KANJI memory unit 55 is transferred to the lower column of the display unit 13 for display purposes. Thereafter, when the operator depresses one of the KANJI selection keys 19*a* to 19*f* corresponding to the display position of the KANJI character displayed on the display unit 13, the KANJI data designated by the reference KANJI memory unit 55 is transferred to the sentence or segment data memory unit 56. Both the data such as symbols other than HIRAGANA stored in the conversion data memory unit 52, and the HIRAGANA data acquired by operating the non-conversion key 15*e*, are directly transferred from the conversion data memory unit 52 into the sentence data memory unit 56. Then, the data stored in the conversion data memory unit 52 is erased after completing the conversion process, or non-conversion process. The data stored in data memory unit 56, instead of the data stored in the conversion data memory unit 52, is then displayed on the display unit 13. In this case, the indefinite data which have been stored in the conversion data memory unit, namely the data which have not yet been converted/non-converted, are displayed on the display unit 13 after the data stored in the sentence data memory unit 56** are displayed.

When, on the other hand, a sentence in the English language or other language using alphabetical characters is to be input into the printer apparatus according to the invention, an operator operates the KANA/alpha entry key **15*j* to instruct entry of the alphabetical characters. The key entry data entered by the character/symbol entry keys 14 under these conditions are directly input into the sentence data memory unit 56** and then displayed.

When the sentence or sentence segment data stored in the sentence data memory unit 56 is to be printed as segments, the cursor "K" is moved to the sentence portion of the displayed data which should be segmented, and the stop key 15*i* is operated. Upon operation of stop key 15*i*, a stop code is input at the position corresponding to the above-described cursor position of the sentence data memory unit 56. Another function of the stop key 15*i* is to store the stop code into the sentence memory unit 56 corresponding to the cursor position when the stop key 15*i* is depressed while the characters are entered by the character/symbol entry keys 14.

Figure 4:
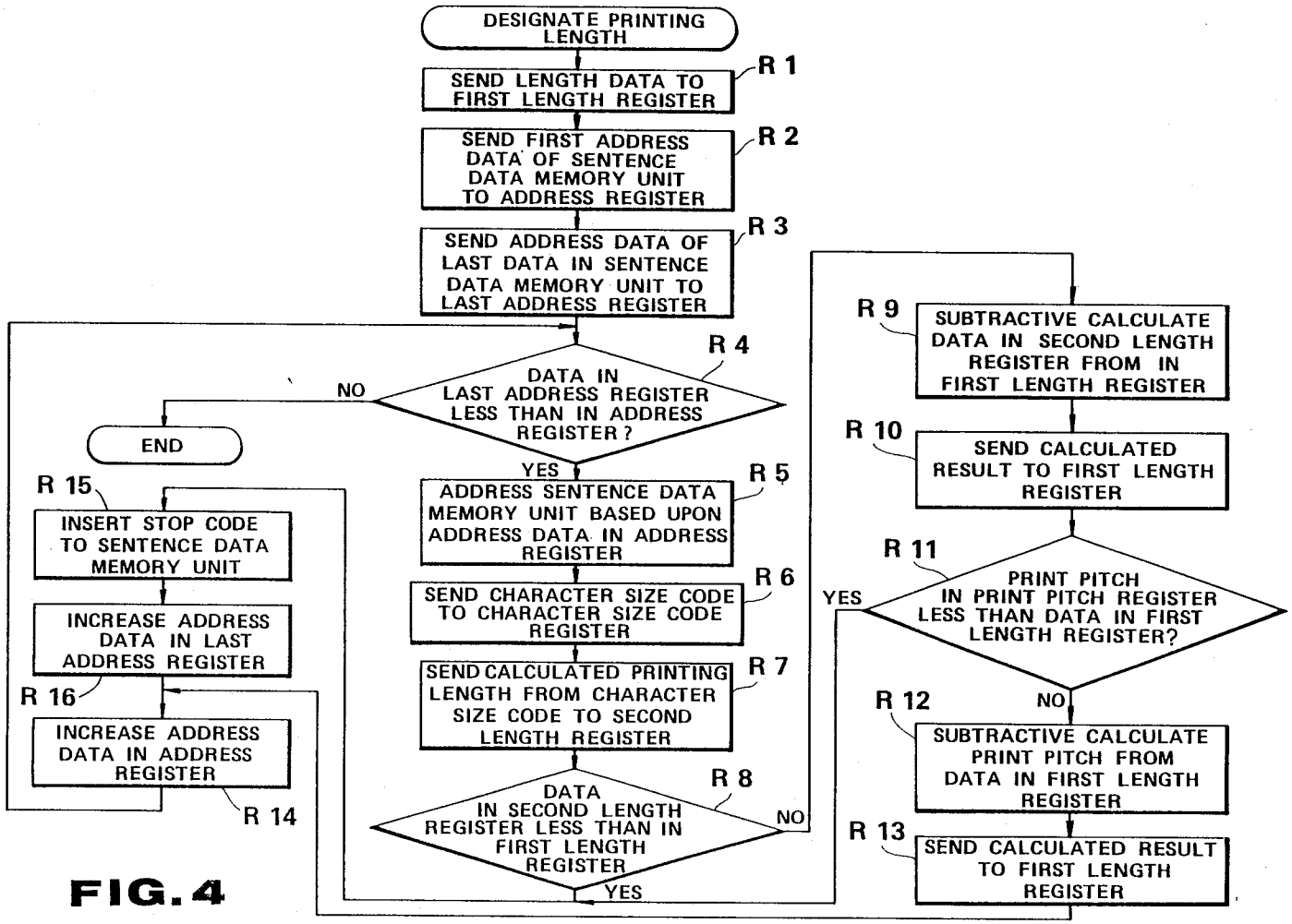
FIG. 4 is a flow chart for explaining controlling of the memory for editing the insertion of the "stop" code corresponding to a designated character string or segment length.

Referring now to the flow chart shown in FIG. 4, the designation operation of the printing length by employing the length key 151 will be described.

When, for example, an input character series is to be segmented into a desired segment length (i.e., desired number of characters) within a predetermined segment length range to be printed out, an operator enters a numeral indicating a character or segment length by way of a numeral entry key after depressing the length key 151. The entered "character or segment length" numeral is input into the first length data register 76 (step R1). Meanwhile, the head address of the sentence data memory unit 56 is input into the address register 73 (step R2), and the address for the last data which has previously been stored in the sentence data memory unit 56 is input (step R3). As previously described, an empty or space length between the successive characters to be printed out is stored in the printing pitch data (empty length data) may be properly set by an operator, or may be previously preset. Thereafter, the content stored in the address register 73 is compared with the content stored in the last address registered in the calculation unit 68 in order to judge whether or not the address for designating the sentence data memory unit 56 at present exceeds the address for the last data stored in the sentence data memory unit 56 (step R4).

When the judgment is made that the content of the address register 73 is smaller than that of the last address register 74 in the comparison step, the control unit 51 addresses the sentence data memory unit 56 in accordance with the content of the address register 73 (step R5) and enters the character size code of the data stored therein into the character size code register 75 (step R6). Then, the calculation unit 68 calculates the printing length of this character based upon the above-described character size code, and compares the content of the first length data register 76 with that of the second length data register 77 after entering the calculated printing length into the second length register 77 (step R7).

Conversely, when the judgment is made that the content of the first length data register 76 is greater than that of the last address register 74, the printing length obtained form the character size code is subtracted from the content of the first length data register 76 (step R9), and the subtraction result is entered into the first length data register 76 (step R10).

Moreover, the content entered into the first length data register 76 is compared with the content input into the printing pitch data register 78 in the calculation unit 68 (step R11). If, as a result of this comparison, the content of the first length data register 76 is greater than that of the printing pitch data register 76, the printing pitch data is subtracted from the content of the first length data register 76 (step R12), and the subtraction result is again entered into the first length data (step R13).

Thereafter, the content of the address register 73 is incremented (step R14) and this incremented content is compared with the content of the last address register 74 (step R4). Then, when the judgment is made that the content of the address register 73 is smaller than that of the last address register 74 in the comparison process, an operation similar to the above-described operation will be performed.

When the judgment is made that the content of the first length register 76 is smaller than that of the second length data register 77 in the comparison step R8, the "stop" code is inserted into the designated address area of the sentence data memory unit 56 (step R15) and the content of the last address register 74 is incremented (step R16). Thereafter, the content of the address register 73 is incremented (step R14), and the above-described operations as defined in the previous steps R4 through R16 are repeated until the content of the address register 73 reaches the content of the last address register 74.

Figures 5A, 5B, 5C:
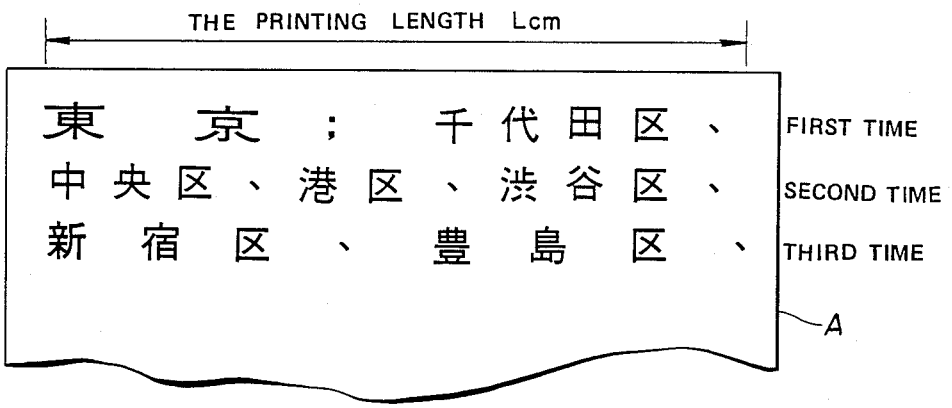
FIGS. 5A and 5B schematically illustrate the memory contents of the sentence data memory unit of the manually operable sweeping-type printer apparatus.
FIG. 5C schematically illustrates printed data printed by the manually-operable sweeping-type printer apparatus.

When, for example, the memory content of the sentence data memory unit 56 is as illustrated in FIG. 5A (in practice, the character code and character side code are input into the portion corresponding to one character shown in FIG. 5A), and a printing length of "L" cm is designated, the "stop" code is entered as illustrated in FIG. 5B and the printing operation is carried out as shown in FIG. 5C.

PRINT OUT OPERATION OF SENTENCE OR SENTENCE SEGMENT DATA

The sentence or segment data which have been produced by way of the appropriate key entry operations, will be printed out as follows.

When the sentence or segment data is to be printed out on a printing medium, e.g., paper, the mode changing switch 11 is changed into the print mode "PR". When the print mode is designated, both the first segmented data stored in the sentence data memory unit 56 and the printing length data of the first data group segmented by each "stop" code are displayed on the display unit 13 as illustrated in FIG. 7A. While an operator holds the printer body 10 with its lower surface being in contact with the printing medium A, as illustrated in FIG. 1, and moves the printer body 10 in an arrow direction indicated by "X" while also depressing the "print" key 20, the data previously stored in the sentence data memory unit 56 is sequentially printed out on the printing medium A.

This printing operation will now be summarized.

When the printer body 10 is moved, the rubber rollers 31 and 32 are rotated as illustrated in FIG. 2. The rotation torque of rollers 31 and 32 is transferred via the gear 34 to the gears 35*a*, 35*b*, 37*a*, and 37*b*. Then, the rotation torque of gear 37*b* is transferred to the encoder disk 38. While encoder disk 38 is rotated, the light irradiated from LED 39 is interruptedly transferred to the photosensor 40 by means of the slits formed on the encoder disk. A pulse signal is derived from the photosensor 40 in response to the interrupted irradiated light.

Also, the rotation torque of the gear 35*b* is transferred to the carbon ribbon take-up shaft 36, which causes the take-up spool 23*b* of the ribbon cassette 22 to be rotated.

As a result, the ink ribbon 24 is moved in accordance with the moving velocity of the printer body 10, and the used ink ribbon 24 is taken up by the take-up spool 23*b*, and the non-used ink ribbon 24 is supplied from the supply spool 23*a* to the thermal head 27.

The encoder pulse "b" output from the photosensor 40 is supplied to the control unit 51 and to the encoder pulse interval counter 61 via delay circuit 62 and OR gate "OR". At this stage, the control unit 51 sequentially designates the memory address of the sentence data memory unit 56, and the sentence data which is designated and previously stored therein is transferred to the printing data judging or detecting unit 72 and printing character generator 59 (FIG. 3). Then, from printing character generator 59, the character pattern data, e.g., 24×24 dots data, corresponding to the above-described sentence data is output and temporarily latched in the head data latch 60 every 1 line (24 dots). Accordingly, the head drive unit 57 drives the heating element of the thermal head 27 in accordance with the sentence or segment data latched in the head data latch 60, based upon the time periods t, $t_1$ and $t_2$ which are determined by the calculating unit 68 in synchronism with the encoder pulse "b". The character pattern of the desired sentence data is printed out on the printing medium "A" in such a manner that the ink coated on the ink ribbon 24 is transferred to the printing medium "A" by driving the thermal head 27 with 1 line times 24.

As previously described in detail, the sentence data which has been stored in the sentence data memory unit 56 is sequentially printed out on the recording or printing medium "A" by moving the printer body 10 in the direction of arrow X in FIG. 1. Then, when the printing data judging unit 72 detects the stop code derived from the sentence data memory unit 56, the stop code detection signal "f" is output to the control unit 51. Upon receipt of this stop code detection signal "f", the control unit 51 immediately stops reading the sentence data from the sentence data memory unit 56 and printing stops, even if the printer is continued to be moved by the user in the direction of said arrow X.

Consequently, the sentence or segment data can be printed with the desired sentence portions segmented by the stop code of the data which has been stored in the sentence data memory unit 56 while moving the printer body 10. This is accurately accomplished without printing more or less than the desired data.

DETAILED PRINTING OPERATION

Referring now to the flow chart shown in FIG. 8, a printing operation of the printer apparatus according to the preferred embodiment will be described in detail.

First, in the key entry mode INP, an operator enters the desired sentence or segment data (for instance, KANJI characters as shown in FIG. 6) into the printer apparatus, and also enters the "stop" code at the end of the segment or sentence i.e., at the desired position of the end of the sentence or segment data for one sweeping operation or designates the printing length (segment length) in accordance with the printing area of the printing medium. It should be noted that FIG. 6 illustrates the sentence or segment data which has been previously stored in the sentence data memory unit 56. Under this condition, both the sentence or segment data as shown in FIG. 7A and an "ST" mark entered by the stop code key 15*i* are displayed, and the succeeding data entry position cursor "k" is moved and flickers on the display unit 13.

Subsequently, when the print mode "PR" is selected, the sentence or segment data from the head portion to the last portion which has been stored in the sentence data memory unit 56, is successively displayed within a range capable of displaying a maximum number of characters on the display unit 13 under its initial condition, as illustrated in FIG. 7B. Also, the lower column of the display unit 13 displays the printing length data of the first data group segmented by each "stop" code, as illustrated in FIG. 7B. In this case, the "ST" mark displayed at the head portion of the display unit 13 will flicker, and the subsequently displayed sentence data corresponds to the printing data which will be printed on a second sweep while moving the printer body 10.

Figure 8:
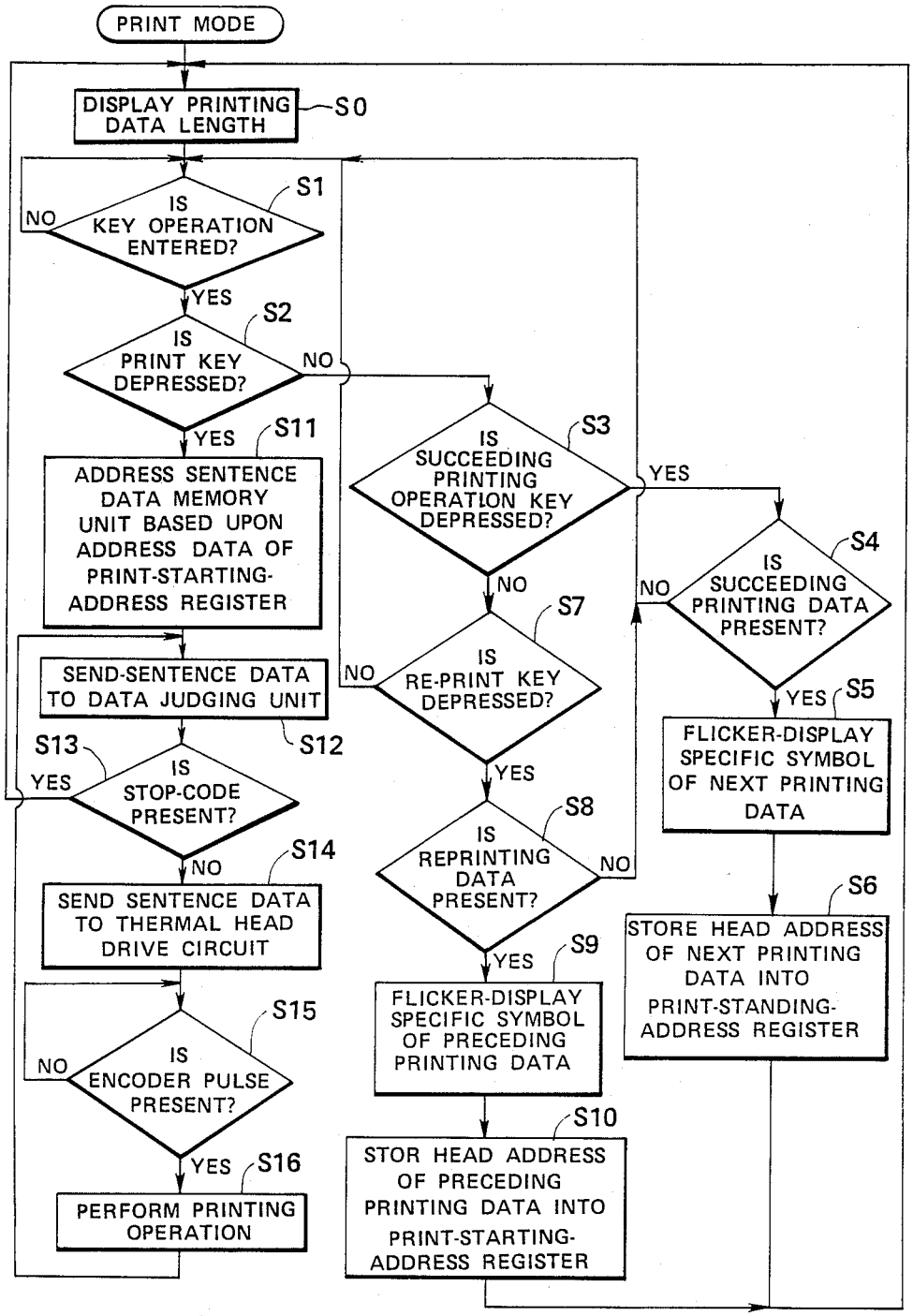
FIG. 8 is a flow chart for explaining the printing operation of the printer apparatus.

FIG. 8 is a flow chart for explaining the various operations in the print mode "PR" while moving the printer body 10 and operating the various keys.

Figure 9A:
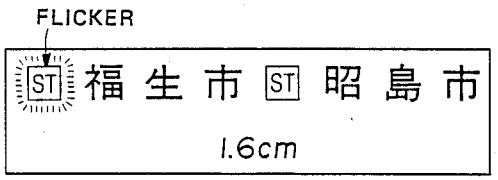
FIGS. 9A through 9G schematically illustrate the display conditions of the data printed out by the printer apparatus during a printing operation.

First, when the print mode PR is instructed by a printer operator, the sentence or segment data from the head portion to the last portion thereof which has been previously stored in the sentence data memory unit 56, is displayed on the display unit 13 within the range capable of displaying the maximum number of the characters, while the heading ST mark flickers thereon (see FIG. 9A). And, the printing length data of the first data group segmented by each "stop" code is displayed on the lower column of the display unit 13 (step SO in FIG. 8). Then, the control unit 51 is under the key entry waiting condition (step S1 in FIG. 8). Under this waiting condition, if the operator wishes to select, as the printing data, the sentence data which is displayed after another "ST" mark succeeding the flickering "ST" mark, the succeeding printing-operation key 15*h* is depressed. Upon depression of succeeding printing-operation key 15*h*, the control unit 51 sequentially reads out the sentence or segment data from the sentence data memory unit 56, and then outputs it to the printing data judging or detecting unit 72.

Then, upon receipt of the stop code detection signal "f" from the data judging or detecting unit 72, the control unit 51 judges whether or not the sentence data has been stored after this stop code (step S4 in FIG. 8). If a check is done that no succeeding printing data is present, there is no change in the display condition. The data which has been selected as the printing data before the succeeding printing operation key 15*h* is operated, is still maintained in the display unit 13. Conversely, if judgment is done and it is determined that the succeeding printing data is present, the ST mark corresponding to the stop code detected by the printing data judging unit 72 is displayed with a flickering condition at the head portion of the display unit 13, and thereafter the data corresponding to the succeeding printing data and the printing length data of the succeeding printing data is displayed (step S5 in FIG. 8, and the display condition shown in FIG. 9B). Also, the head address of the sentence or segment data corresponding to the succeeding printing data in the sentence data memory unit 56, is stored in the print-starting-address register 71. Under this condition, when the succeeding printing-operation key 15*h* is continuously operated, the above-mentioned process steps S4 to S6 are performed. If the succeeding printing data is present, the data corresponding to this succeeding printing data is successively displayed from the head portion to the last portion of the display unit 13 and the printing length data of this succeeding printing data is displayed on the lower column of the display unit 13. Further, the contents of the print-starting-address register 71 are updated.

Figure 9B:
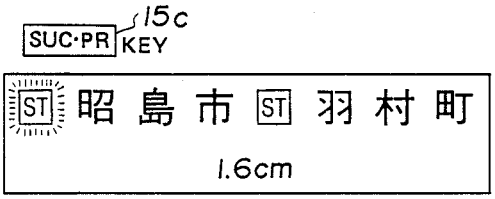
Figure 9C:
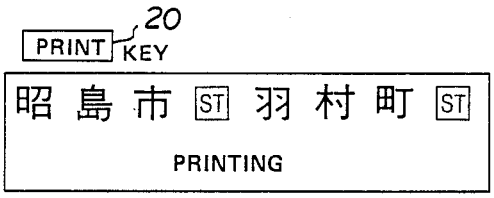
Figure 9D:
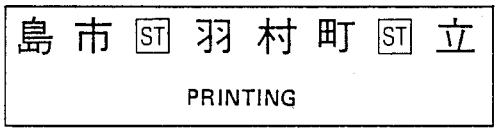
Figure 9E:
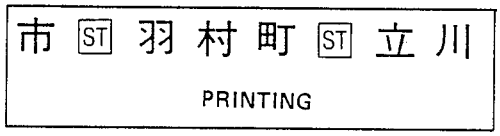

Under the display condition shown in FIG. 9B, if the print key 20 is depressed, and the printer body 10 is moved in the direction indicated by the arrow "X", the indication "PRINTING" is displayed on the display unit 13 (See FIG. 9C), and then the Japanese symbols corresponding to Akishima City are printed. That is to say, when the print key 20 is depressed, the control unit 51 addresses the sentence data memory unit 56 based upon the address data which has been stored in the print-starting-address register 71 so as to successively read out the sentence data (step S11 in FIG. 8) and to output the read sentence data to the data judging unit 72 (step S12).

Thereafter, the data judging unit 72 judges whether or not the data supplied from the sentence data memory unit 56 corresponds to the stop code (step S13). If not, namely if the stop code detection signal "f" has not yet been output from the data judging unit 72 to the control unit 51, the character pattern data is supplied to the thermal head drive circuit 57 (step S14), which has been read out by the character generator 59 in accordance with the data read from the sentence data memory unit 56, and the control process becomes the encoder pulse waiting condition (step S15). Then, when the encoder pulse "b" is input, the printing operation of the sentence data is executed in accordance with the head driving process, which will be discussed later (step S16). It should be noted that this character pattern data is, for instance, a dot pattern constructed of 24×24 dots. Since the dot pattern of 24 dots is printed out with respect to one encoder pulse "b" in the thermal head 27, one complete character pattern can be printed when 24 encoder pulses "b" have been output. However, for the sake of simplicity, the above-described processing steps are involved in the control process step S16 of the flow chart shown in FIG. 8.

With the above-described control process, the desired print data corresponding to Akishima City has been printed on the printing medium while the printer body 10 is moved. On the display unit 13, the displayed data is scrolled in accordance with the addressing of the sentence data memory unit 56 under the control of the control unit 51, namely the data under the printing.

Then, when the above-desired print data corresponding to Akishima City is read from the sentence data memory unit 56 has been printed out, and thereafter the stop code is read, the stop code detection signal "f" is output from the data judging unit 72 (step S13), and the control unit 51 is brought into the key entry waiting condition (step S1). Under this condition, the printer apparatus does not perform a printing operation even if the printer body 10 is continuously moved. As a result, no further data is printed on the printing medium "A". The data stored in the sentence data memory unit 56 after said desired print data corresponding to Akishima City is displayed with the ST mark at the head portion (see FIG. 9F). Thereafter, when the depression of the print key 20 is released, the address of the sentence data memory unit 56 corresponding to the heading data of Hamura town is stored in the print-starting-address register 71, and thus, the segment data corresponding to Hamura town is selected as the next printing data.

Figure 9F:
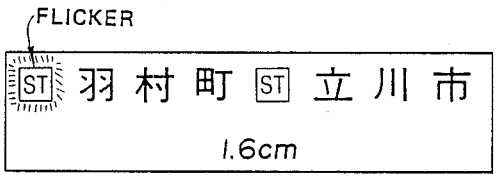
Figure 9G:
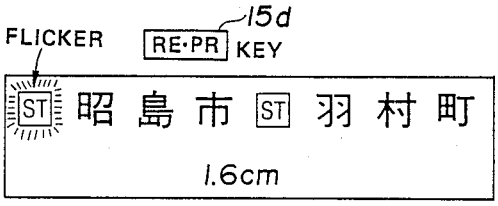

If said desired printing data corresponding to Akishima City is desired to be again printed under the display condition of FIG. 9F, the re-print key 15*g* is operated. In accordance with the operation of the re-print key 15*g*, the control unit 51 accesses the sentence data memory unit 56 to judge whether or not the sentence data, namely the reprinting data is present before the ST mark which has been displayed at the heading portion of the display unit 13 (step S8). If no, the conditions before the reprinting key 15*g* is operated are maintained. To the contrary, if the reprinting data is present, the sentence data is supplied to the data judging unit 72 while sequentially incrementing the address for designating the sentence data memory unit 56. Then, when the stop code is detected in the data judging unit 72, the ST mark corresponding to this stop code is driven at the head portion of the display unit 13, with the flicker condition, and the data which has been stored after the above-described stop code data in the sentence data memory unit 56, and the printing length data is subsequently displayed thereon (see FIG. 9G). In addition, the head address of the reprinting data in the sentence data memory unit 56 is stored in the print-starting-address register unit 71 under the control of the control unit 51 (step S10). When the reprint key 15*g* is again depressed under such a condition that the display as shown in FIG. 9G is executed, the display condition of the display unit 13 is shown in FIG. 9A as a result of the similar process. The data corresponding to, for example, Fussa City, is selected as the printing data by the next scanning operation. If the succeeding printing-operation key 15*h* is operated, the above-described processing steps S4 to S6 are executed so that the display condition shown in FIG. 9F is obtained. The data corresponding to HAMURA town is selected as the printing data during the next scanning operation.

Figure 10:
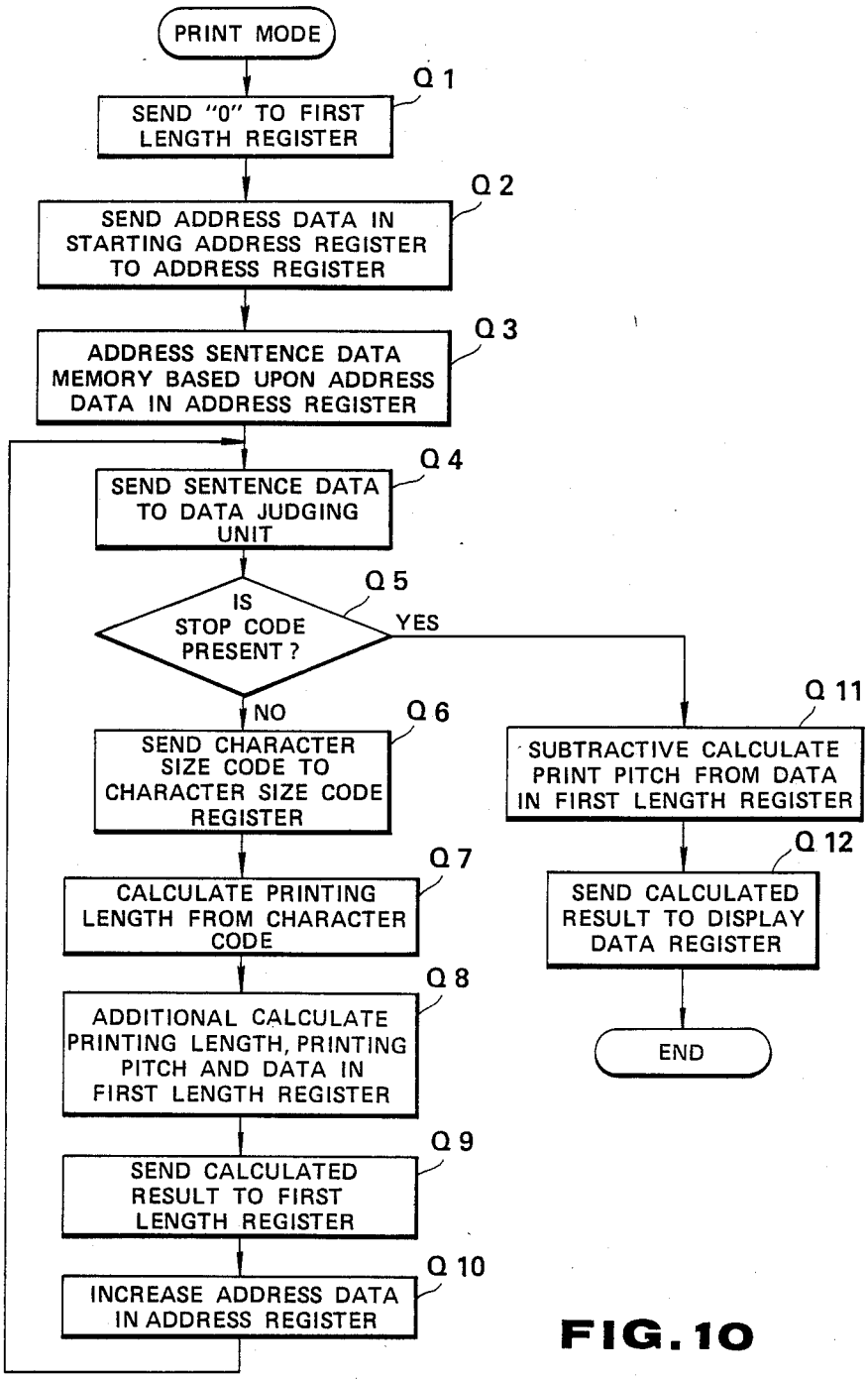
FIG. 10 is a flow chart for explaining controlling of the printing length calculations.

Referring now to the flow chart of FIG. 10, a description will be made of the printing length display operation at the step SO shown in FIG. 8.

First, when the print mode is designated by operating the mode changing switch 11, "0" is set in the first length data register 76 (step Q1). On the other hand, the content of the print-starting-address register 71 is input into the address register 73 (step Q2). Then, the sentence data memory unit 56 is addressed in accordance with the content of the address register 73 (step Q3), and thereafter this content is input into the printing data judging unit 72. In the printing data judging unit 72, a check is made as to whether or not the data input from the sentence data memory unit 56 corresponds to the "stop" code (step Q5). If the input data does not correspond to the "top" code in the printing data judging unit 72, the character size code of the data output from the sentence data memory unit 56 is entered into the character size code register 75 (step Q6). As a result, the calculation unit 68 commences its calculation of the printing length of this entered character based upon the character code previously stored in the character size code register 75 (step Q7), and furthermore, sums the printing pitch data previously stored in the printing pitch data register 78 and the data previously stored in the first length data register 76 (step Q8). Then the summing result is entered into the first length data register 76 (step Q9), the memory content of the address register 73 is incremented (step Q10) and the control process is returned to step Q4.

Subsequently, the above-described process (steps Q4 to Q10) are repeated until the "stop" code is detected in the printing data judging unit 72 (step Q5). When the "stop" code is detected in the printing data judging unit 72 (step Q5), the calculation unit 68 subtracts the printing pitch data from the memory content of the first length data register 76 (step Q11), and the subtraction result is entered into the display data register 79 and displayed on the display unit 13 under the control of the control unit 51.

PRINTING CONTROL PROCESS

Referring to the flow charts shown in FIGS. 11A–11C, the printing control process during the above-described sentence data printing operation will be described.

Figure 11A:
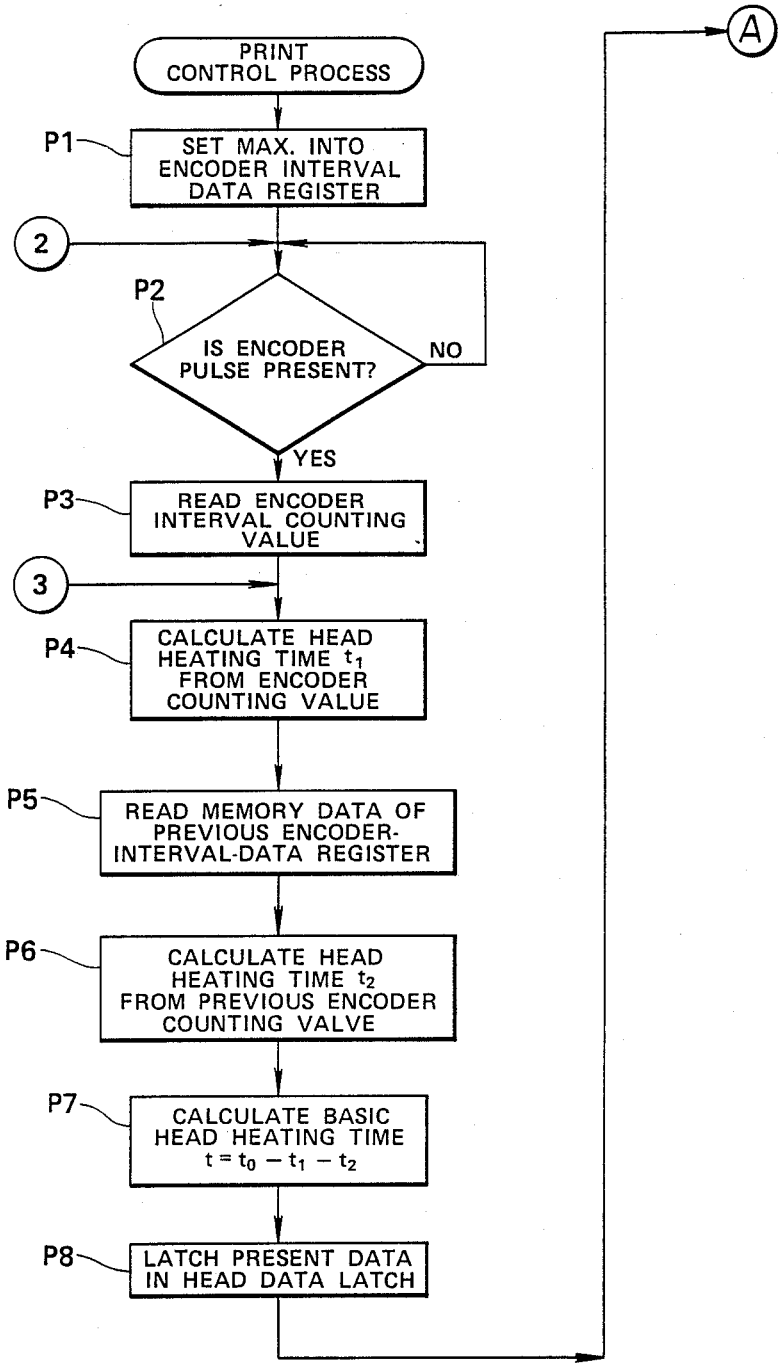
Fig. 11*a*–11C are flow charts for explaining the controlling of the timing of the power supply to the printer head of the printer apparatus.
Figure 11B:
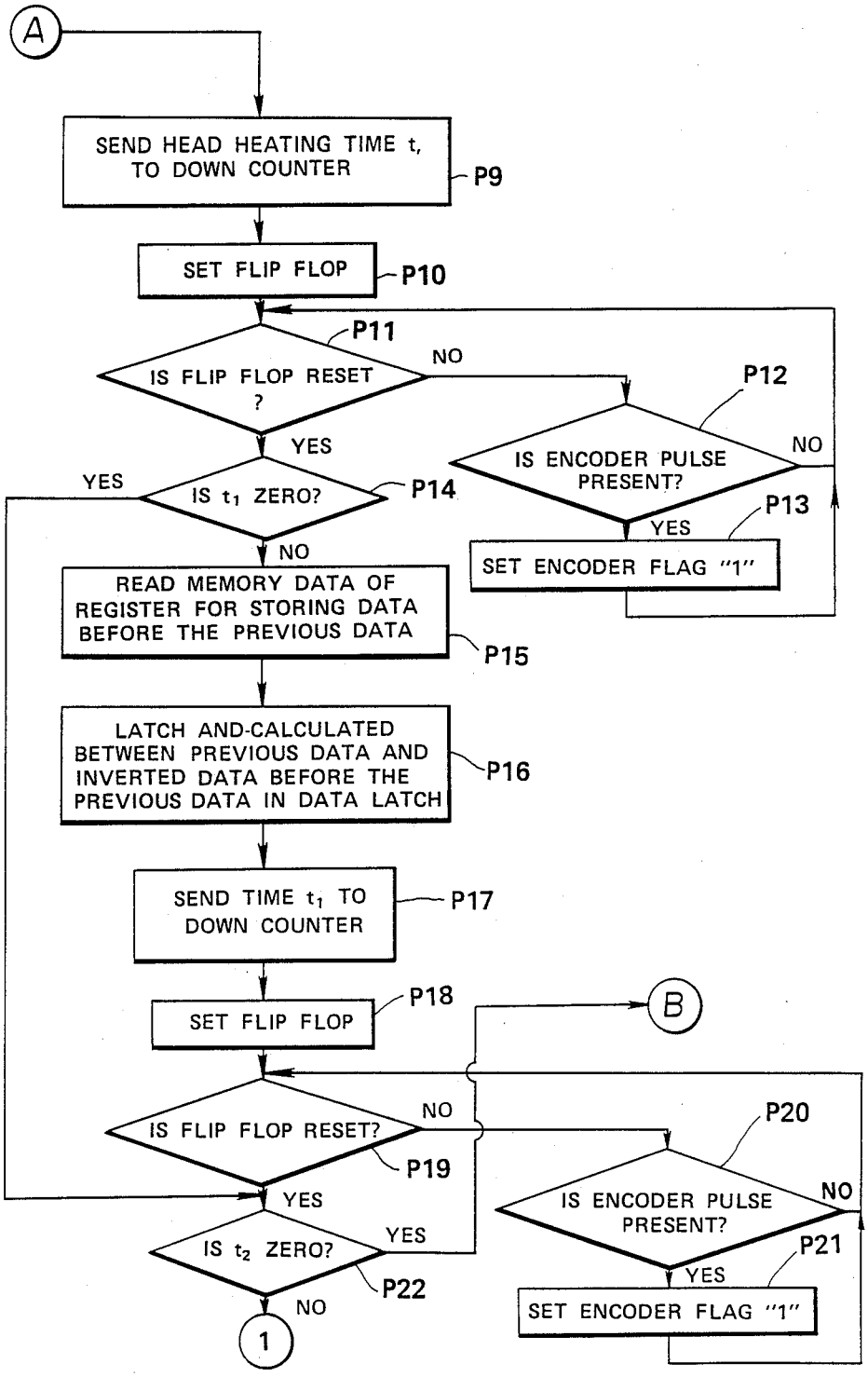
Figure 11C:
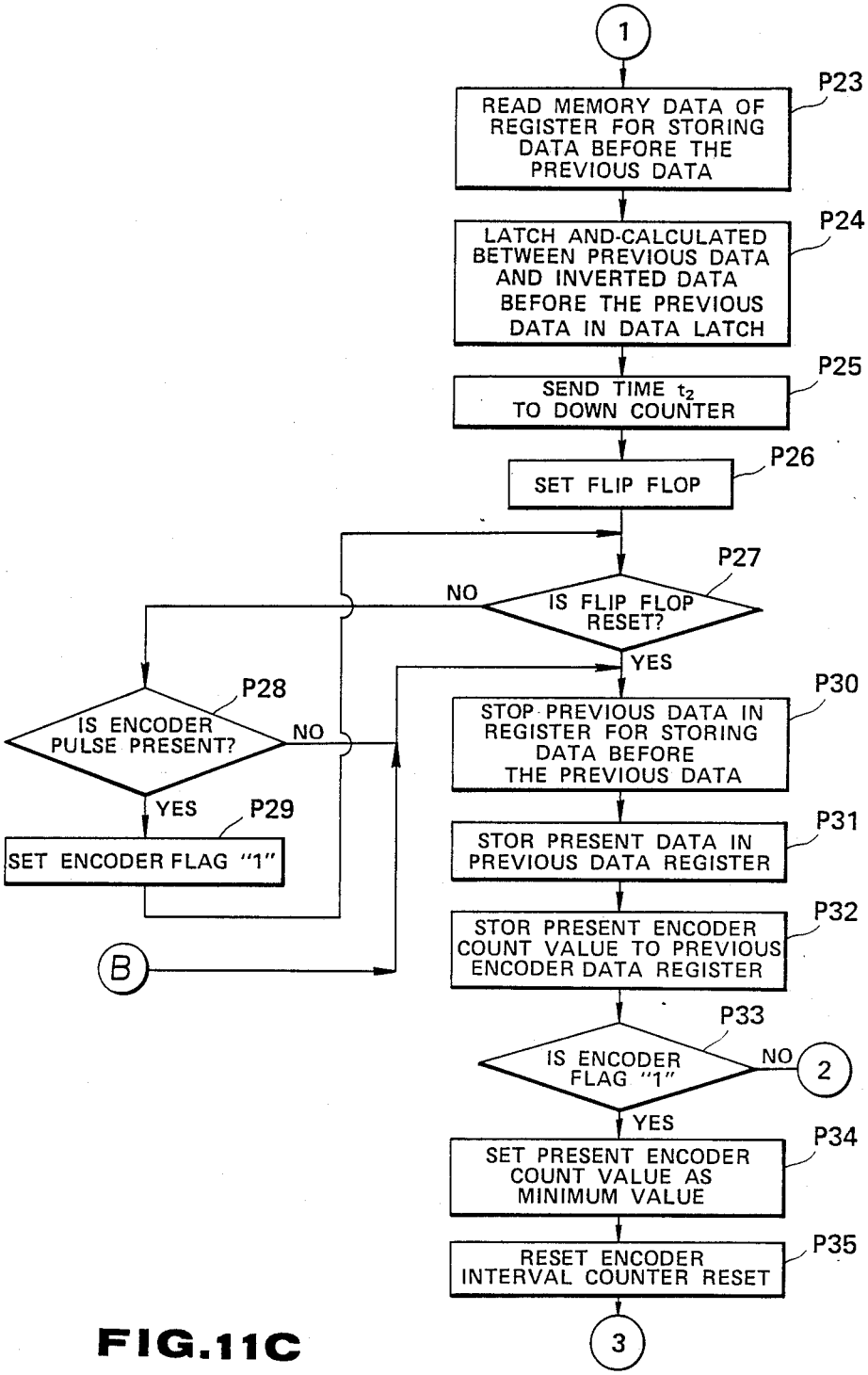

First, when the print mode PR is set by a printer operator, the maximum value of the previous encoder-interval-data register 65 is set therein (step P1 in FIG. 11A). This maximum value is a preset value which is determined based upon a time period required for lowering the temperature of the heated heater (not shown in detail) of the thermal head 27 to substantially room temperature. This preset value has previously been stored in ROM (not shown in detail) in the control unit 51. When the print key 20 is operated, the control unit 51 is brought into the encoder pulse waiting condition. Then, when the encoder pulses "b" are output in accordance with the movement of the printer body 10, the encoder interval counting value is read from the encoder interval counter 61 (steps P2 and P3). Then, the control unit 51 supplies the above-described encoder interval counting value to the calculation unit 68 so as to calculate the time period "$t_1$" for supplying power to the thermal head. Similarly, the control unit 51 reads out the previous encoder-interval-data counting value from the previous encoder-interval-data register 65 and supplies the read counting value to the calculation unit 68 so as to calculate the time period "$t_2$" for supplying power to the head (steps P5 and P6). Furthermore, the calculation unit 68 performs a subtraction to obtain the basic time period "t" for supplying power to the head from the resultant time period $t_1$ and $t_2$ in the above steps under control of the control unit 51, i.e., $t=t_0-t_1-t_2$ (step P7). It should be noted that the above-described time period "$t_0$" corresponds to the basic time period for supplying power to the thermal head, e.g., 1,400 u sec, which has been previously stored in ROM of the control unit 51.

As previously described, when the time periods $t_1$, $t_2$ and t required for the present printing operation are calculated, the printing data, i.e., 1-line character pattern data corresponding to the data read from the sentence data memory unit 56, is transferred to the head data latch 60 (step P8) for performing the printing operation at the present time. The control unit 51 sets the basic time period "t" for supplying power to the head 27 to the down counter 69 (step P9), and supplies the control signal "i" to the flip-flop "F/F" so as to set flip-flop F/F (step P10). The heating element corresponding to the position of the black "1" of the present printing data in the thermal head 27 is powered to be heated by the head drive unit 57 while the down counter 69 performs the down counting operation. Then, when the down counting operation is completed and the reset signal is output to the flip-flop F/F, flip-flop F/F is brought into the reset condition, and the operation of the head drive unit 57 is temporarily stopped (step P11). Then, the control unit 51 judges whether or not the time period "$t_1$" calculated in the above step P4 is equal to "zero" (step P14). If not, under the control of the control unit 51, the preceding printing data is read from the previous data memory unit 63, and the AND calculation is performed for the present printing data and the inverted data of the previous printing data. In other words, the data is produced, by which only the heating element defined by the previous printing data of "0" and also the present printing data of "1" is heated. This data is latched in the head data latch 60 (steps P15 and P16). Then, the above-described time period "$t_1$" is set to the down counter 69 and also the flip-flop is set so as to commence the down counting operation (steps P17, P18). Under this condition, the thermal head drive unit 57 heat-drives the heating element of the thermal head 27 during the time period "$t_1$", which is defined by the fact that the previous printing data obtained by the AND-calculation becomes "0" and the present printing data become "1". The above-described processing operation is to aim the preliminary heat process during the time period "$t_1$", since a larger temperature decrease is provided when the preceding printing data becomes white "0", as compared with black "1".

When the flip-flop F/F is reset in response to the reset signal "h" derived from the down counter 69 after the above-described time period "$t_1$" has elapsed, the control unit 51 judges whether or not the time period "$t_2$" calculated in the previous step P6 is equal to zero (steps P19 and P22). If the time period "$t_2$" is not equal to zero, the control unit 51 reads the printing data from the memory unit 64 for storing the printing data preceding the previous printing data, and AND-calculates both the present printing data and the inverted data for the printing data preceding the previous printing data. The resultant data is output to the head data latch 60. Then, the above-described time period "$t_2$" is set to the down counter 69, the flip-flop F/F is set, and then the heating operation of the thermal head 27 is commenced (steps P25 and P26).

It should be noted that the above-described printer controlling operation has the same purpose as in the printer controlling operation where the previous printing data is employed. In other words, only the heating element of the thermal printer 27 in case that the printing data before the previous printing data is white "0" and the present printing data is block "1", is driven during the time period "$t_2$", whereby a difference in the lowered temperatures between the previous printing data and the printing data before the previous printing data can be compensated.

Then, when the flip-flop F/F is brought into the reset condition in response to the down counter 69 after the time period "$t_2$" has elapsed, the heating operation of the thermal printer 29 for 1-line printing data is accomplished (step P27). If the moving velocity of the printer body 10 becomes fast, as compared with the processing time required for the head heating operation, the successive encoder pulse "b" is output from the encoder 41 during the head heating operation. In such a case, the encoder flag stored in flag latch 67 is changed into "1" for this encoder pulse "b" during the steps P12, P13, P20, P21, P28 and P29.

After the above-described heating operation is completed, the following signal process is carried out under the control of the control unit 51. The data stored in the previous data register 63 is entered to the register 64 for storing the data before the previous data; the data stored in the present data register 66 is input into the previous data register unit 63; and the present encoder interval counting value is set into the previous encoder-interval-data register 65 (steps P30, P31, and P32). This encoder interval counting value corresponds to the value counted in the encoder interval counter between the previous encoder pulse "b" and the present encoder pulse "b". Thereafter, the control unit 51 judges whether or not the content of the encoder flag latch 67 is "1". If no, the control process of step P2 is executed, i.e., the waiting condition for the encoder pulse "b". If, however, the content of the encoder flag latch 67 is "1", the counting value of the present encoder interval counter is determined as the minimum value (step P34), and after the encoder interval counter 61 is reset (step P35), the control process of the step P4 is executed. That is, the time periods $t_1$, $t_2$ and t are calculated. It should be noted that the minimum value preset as the encoder interval counting value corresponds to predetermined data which has been previously stored in ROM of the control unit 51.

WAVEFORMS OF HEATING PULSE

Figure 12:
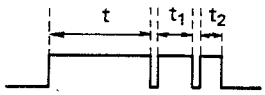
Fig. 12 illustrates a relationship between the time for supplying power to the printer head, the preceding print data, and the print data previous to the preceding print data acquired by controlling the timing for supplying power to the printer head.
Figure 12:
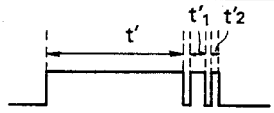
Figure 12:
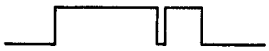
Figure 12:
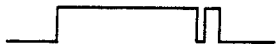
Figure 12:
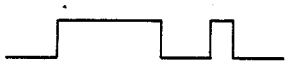
Figure 12:
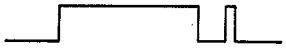
Figure 12:
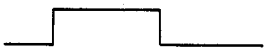
Figure 12:
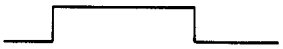

In FIG. 12, there are shown waveforms of pulses for supplying power to the heating element of the thermal head 27, which are categorized as two stages of the moving velocity of the printer body 10. That is, the time periods $t_1$ and $t_2$ are set long to compensate for the great temperature difference between the heated heating element and the non-heated heating element when the heating control operation for the thermal head 27 is performed with respect to the previous printing data and the printing data before the previous printing data under the fast moving velocity of the printer body 10. Conversely, the time periods $t_1$ and $t_2$ are set short to compensate for the small temperature difference between them during the slow moving velocity of the printer body 10. Since another time period "t" is obtained by subtracting these time periods $t_1$ and $t_2$ from the basic time period $t_0$, this time period "t" becomes short when the temperature lowering in the heater element during the previous printing operation is small under the fast moving velocity of the printer body 10, whereas it becomes long when the temperature lowering in the heater element during the previous printing operation is great under the slow moving velocity of the printer body 10.

Figure 13A:
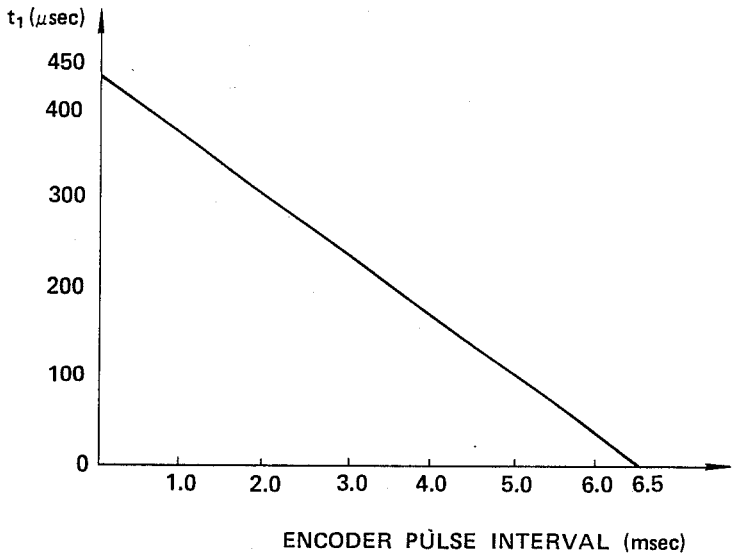
Figure 13B:
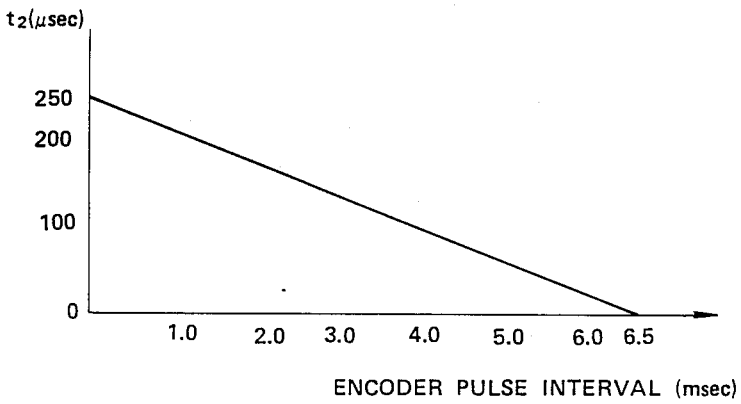

It should be noted that these time periods $t_1$ and $t_2$ for supplying power to the thermal head are obtained by executing the calculation formulae which are acquired based upon the graphic representations shown in, for instance, FIGS. 13A and 13B.

It is also possible to produce a look-up table based upon the graphic representations of FIGS. 13A and 13B so as to obtain the above-described time periods $t_1$ and $t_2$, and to store it in ROM of the control unit 51. Moreover, another table for defining the encoder pulse interval and the time period "t" for supplying power to the thermal head, as illustrated in FIG. 11, may be provided in ROM of the control unit 51. Then, this time period "t" may be calculated in accordance with the encoder pulse interval counting pulse, and the remaining time periods $t_1$ and $t_2$ may be obtained by distributing the calculation result of $(t_0-t_1)$ at a predetermined ratio.

Various modifications and alterations can be made within the scope of the invention as defined in the appended claims.

What is claimed is:

1. A hand-held electronic printing, apparatus comprising:

a manually manipulatable housing means which is manually sweepable across a printing medium;

printing means carried by said housing means for printing information on a printing medium positioned outside of said housing means, when said housing means is manually swept across said printing medium;

position-detecting means for detecting a position of said printing means relative to said printing medium as said housing means is manually swept across said printing medium, and for producing position-detecting signals every time said housing means is swept over a predetermined distance, said position-detecting signals representing the position of said housing means with respect to said printing medium;

signal source means for storing information which is segmented into a plurality of information items, and for generating information signals corresponding to information to be printed;

selecting means for selecting one of said segmented information items stored in said signal source means;

display means having a display area for successively displaying information contained in said segmented information item selected by said selecting means, said display means displaying said information beginning at a position corresponding to a head position of said display area;

signal supplying means for sequentially supplying information signals corresponding to information contained in said information item selected by said selecting means from said signal source means to said printing means;

control means for controlling said printing means in response to said position-detecting signals and for causing said printing means to print said information contained in said selected information item on said printing medium in response to said information signals supplied thereto from said signal source means;

detecting means for detecting the end of said information signals of said information items which are sequentially supplied from said signal source means and for outputting a detection signal responsive to detection of the end of said information signals of said information items; and stopping means coupled at least to said detecting means for stopping a printing operation of said printing means in response to said detection signal output from said detecting means, thereby always stopping printing at the end of a segmented information item regardless of further sweeping of said housing means relative to said printing medium.

2. The hand-held printing apparatus of claim 1, wherein said signal source means includes:

key-input means for inputting data including at least alphanumeric data and segment code data designating the end of said information signals of each information item;

memory means for storing data input by said key-input means; and information signal generating means coupled to said memory means for reading out data from said memory means, and including means for generating information signals in response to alphanumeric data read out from said memory means;

said display means including means for displaying the data input by said key-input means and the data read out from said memory means; and said detecting means including means for detecting segment code data read out form said memory means for detecting the ends of said information signals of said information item, and for thereby producing said detection signal.

3. The hand-held printing apparatus of claim 2, wherein said stopping means includes means for stopping the reading out of data from said memory means upon receipt of said detection signal from said detecting means.

4. The hand-held printing apparatus of claim 3, wherein said signal source means is mounted within said housing means.

5. The hand-held printing apparatus of claim 1, wherein said signal source means is mounted within said housing means.

6. The hand-held printing apparatus of claim 2, further comprising:

calculating means for calculating a printing length of the data stored in said memory means; and coupling means for coupling said display means with said calculating means for displaying the printing length calculated by said calculating means on said display means.

7. The hand-held printing apparatus of claim 7, wherein said calculating means includes means for calculating the printing length of said information item selected by said selecting means.

8. The hand-held printing apparatus of claim 2, wherein said display means includes:

character pattern generating means for generating a character pattern in accordance with alphanumeric data input by said key-input means, and for generating a specific character pattern in accordance with segment code data input by said key-input means.

9. The hand-held printing apparatus of claim 6, wherein said display means includes display control means for successively displaying alphanumeric data contained in said information item selected by said selecting means from a head portion of a display area.

10. The hand-held printing apparatus of claim 1, wherein said signal source means includes:

segment length designating means for designating a segment length of one information item to be printed in advance of a printing operation, so as to permit segmenting said information into a plurality of said information-items; and signal segment code means for segmenting the information signals in accordance with said segment length designated by said segment length designating means.

11. The hand-held printing apparatus of claim 10, wherein said signal source means further includes:

key-input means for inputting at least alphanumeric data;

memory means for storing the data input by said key-input means; and information signal generating means for generating information signals in response to alphanumeric data output from said memory means;

said signal segment code means including means for inserting a segment code data into said memory means in response to said segment length designated by said segment length designating means, and said detecting means includes means for detecting the segment code data output from the memory means to detect the ends of said information signals of said information items, thereby producing said detection signal.

12. The hand-held printing apparatus of claim 11, wherein said signal segment code means includes:

calculating means for calculating a printing length of the data stored in said memory means;

comparing means for comparing the printing length calculated by said calculating means with the segment length designated by said segment length designating means, and for detecting the last data existing within the range of the segment length; and inserting means for inserting the segment code data into the area of the last data detected by said comparing ;means of said memory means.

13. The hand-held printing apparatus of claim 1, wherein said printing means includes:

a thermal printer head; and ink ribbon means interposed between said thermal printer head and said printing medium, for transferring ink onto said printing medium while said thermal printer head is operated.

14. The hand-held printing apparatus of claim 13, wherein said control means includes:

velocity detecting means for detecting a moving velocity of said ;housing means as it is swept over the printing medium;

information signal memory means for storing an information signal which has been printed by the thermal printer head in response to at least a "next-to-last" position-detecting signal output form said position-detecting means;

comparing means for comparing information signals previously stored in said information signal memory means with present printing information signals, and for outputting the comparison result to said thermal printer head; and heating control means for controlling a heating amount of said thermal printer head in accordance with the moving velocity detected by said velocity detecting means and said comparison result.

15. The hand-held printing apparatus of claim 14, wherein said velocity detecting means includes means for measuring a time interval between two succeeding position-detecting signals produced by said position-detecting means.

16. The hand-held printing apparatus of claim 14, wherein said comparing means includes means for performing an AND-calculation between present printing information signals and inverted signals of information signals previously stored in said information signal memory means, and for outputting the result of said AND-calculation to said thermal printer head.

17. The hand-held printing apparatus of claim 14, wherein said heating control means includes means for controlling a time period for supplying power to said thermal printer head.

18. The hand-held printing apparatus of claim 17, wherein said heating control means includes:

first power-supply means for supplying power to said thermal printer head for printing information corresponding to present printing information signals for a relatively long time period for a moving velocity of said housing which is lower than a given moving velocity of said housing as detected by said velocity detecting means;

second power-supply means for supplying power to said thermal printer head in accordance with said comparison result obtained from said comparison means for a relatively short time period for a moving velocity of said housing which is lower than said given moving velocity of said housing as detected by said velocity detecting means; and power-supply control means for activating said first power-supply means and said second power-supply means in sequence.

19. The hand-held printing apparatus of claim 18, wherein said first power-supply means supplies power to said thermal printing head for a relative short time period for a moving velocity of said housing which is higher than a given moving velocity of said housing as detected by said velocity detecting means; and said second power supply means supplies power to said thermal printing head for a relatively long time period for a moving velocity of said housing which is higher than said giving moving velocity of said housing as detected by said velocity detecting means.

20. The hand-held printing apparatus of claim 2, wherein said selecting means includes:

transfer means for transferring each of said information items from said memory means to said display means in a predetermined sequence; and designating means for designating said information item which is being displayed on said display means, so as to select one of said information items to be printed.

21. The hand-held printing apparatus of claim 20, wherein said selecting means further includes a specific key for activating said transfer means, whereby said transfer means transfers one of said information items from said memory means to said display means, every time said specific key is operated.

22. A hand-held electronic printing apparatus including a manually manipulatable housing means, said housing means comprising:

printing means for printing information on a printing medium positioned outside said housing means, when said housing means is manually swept across said printing medium;

position-detecting means for detecting the position of said printing means being ;manually swept across said printing medium, and for producing position-detecting signals every time said housing means is swept over a predetermined distance, said position-detecting signals representing the position of said housing means with respect to said printing medium;

velocity detecting means responsive to said position-detecting signals for detecting a moving velocity of said housing means over said printing medium;

information signal memory means for storing an information signal which has been printed by said printing means in response to at least a next-to-last portion detecting signal output from said position-detecting means;

comparing means for comparing the information signal stored in said information signal memory means with a present printing information signal, and for outputting the comparison result to said printing means; and drive controlling means for controlling said printing means in response to said position-detecting signals in accordance with the velocity detected by said velocity detecting means, and also in accordance with said comparison result of said comparing means

23. The hand-held printing apparatus of claim 22, wherein said printing means comprises a thermal printer.

24. The hand-held printing apparatus of claim 23, wherein said drive controlling means includes means for controlling a heating amount of said thermal printer.

25. The hand-held printing apparatus of claim 24, wherein said drive controlling means includes means for controlling a time period for supplying power to said thermal printer.

26. The hand-held printing apparatus of claim 25, wherein said comparing means includes means for performing an AND-calculation between present printing information signals and inverted signals of information signals previously stored in said information signal memory means, and for outputting the result of said AND-calculation to said thermal printer head.

27. The hand-held printing apparatus of claim 22, further including;

key-input means for inputting data;

memory means for storing data input by said key-input means;

information signal generating means for reading out data from said memory means and for generating information signals in response to the data read out from said memory means; and display means for displaying at least one item of the data stored in said memory means and the data directly input by said key-input means.

28. A method of operating a hand-held electronic printing apparatus which includes a manually manipulatable housing means, a display means carried by said housing means and having a display area, and a printing means carried by said housing means for printing information on a printing medium positioned outside of said housing means, the method comprising:

storing information which is segmented into a plurality of information items;

generating information signals corresponding to information to be printed;

selecting one of said information items;

displaying information contained in said selected information item at a position beginning from a head position of said display area of said display means;

manually sweeping said housing means across a printing medium;

detecting a position of said printing means relative to said printing medium as said housing means is manually swept across said printing medium, and producing position-detecting signals every time said housing means is swept over a predetermined distance, said position-detecting signals representing the position of said housing means with respect to said printing medium;

sequentially supplying information signals corresponding to information contained in said selected information item to be printed, to said printing means;

controlling said printing means in response to said position-detecting signals and causing said printing means to print said information on said printing medium in response to said sequentially supplied information signals;

detecting the end of said information signals of said selected information item, which information signals are sequentially supplied to said printing means, and outputting a detection signal responsive to detection of the end of said information signals of said selected information item; and stopping a printing operation of said printing means in response to said outputted detection signal, thereby always stopping printing at the end of a segmented information item regardless of further sweeping of said housing means relative to said printing medium.

29. The method of claim 28, further comprising:

inputting data including at least alphanumeric data and segment code data designating the end of said information signals of each information item;

storing said inputted data in a memory means;

reading out data from said memory means, and generating information signals in response to said alphanumeric data read out form said memory means; and detecting segment code data read out from said memory means for thereby detecting the ends of said information signals of said information item, and producing said detection signal.

30. The method of claim 29, comprising stopping the reading out of data from said memory means upon generation of said detection signal.

31. The method of claim 30, further comprising:

calculating a printing length of the data stored in said memory means; and displaying the calculated printing length on said display means carried by said housing means.

32. The method of claim 28, further comprising:

designating a segment length of a plurality of information items to be printed; and segmenting the information signals in accordance with said designated segment length.

33. The method of claim 32, further comprising:

inputting at least alphanumeric data;

storing the inputted data in a memory means;

generating information signals in response to alphanumeric data output from said memory means;

said step of sequentially supplying information signals including inserting a segment code data into said memory means in response to said designated segment length so as to segment the information into a plurality of information items and said detecting step includes detecting the segment code data output from the memory means to detect the segments of said information signals, thereby producing said detection signal.

34. The method of claim 33, comprising:

calculating a printing length of the data stored in said memory means in advance of a printing operation;

comparing the calculated printing length with the designated segment length, and detecting the last data existing within the range of the segment length; and inserting the segment code data into the area of the last detected data of said memory means.

35. The method of claim 28, wherein said controlling step includes:

detecting a moving velocity of said housing means as it is swept over the printing medium;

storing an information signal which has been printed by the thermal printer head in response to at least a "next-to-last" position-detecting signal;

comparing previously stored information signals with present printing information signals, and outputting the comparison result to said thermal printer head; and controlling a heating amount of said thermal printer head in accordance with the detected moving velocity of said housing means and said comparison result.

36. The method of claim 35, wherein said velocity detecting step includes measuring a time interval between two succeeding position-detecting signals.

37. The method of claim 35, wherein said heating control step includes controlling a time period for supplying power to said thermal printer head.

* * * * *

UNITED STATES PATENT AND TRADEMARK OFFICE

CERTIFICATE OF CORRECTION

PATENT NO. : 4,915,027

DATED : April 10, 1990

INVENTOR(S) : ISHIBASHI et al

It is certified that error appears in the above-identified patent and that said Letters Patent is hereby corrected as shown below:

Column 21, claim 7, line 25, change "of claim 7" to --of claim 6--.

Column 21, claim 9, line 37, change "of claim 6" to --of claim 2--.

Column 22, claim 14, line 31, change "form" to --from--.

Column 23, line 45, change "being ;manually" to --being manually--.

Signed and Sealed this

Twentieth Day of April, 1993

*Attest:*

MICHAEL K. KIRK

*Attesting Officer*

*Acting Commissioner of Patents and Trademarks*